US010246898B2

(12) United States Patent
Jin et al.

(10) Patent No.: US 10,246,898 B2
(45) Date of Patent: Apr. 2, 2019

(54) CENTRALIZED LOCKING AND UNLOCKING MECHANISMS FOR TENT FRAMES AND TENT FRAMES HAVING SAME

(71) Applicant: Luhua (Xiamen) Trading Co., Ltd., Xiamen (CN)

(72) Inventors: Juyoung Jin, Xiamen (CN); Kwanjun Choi, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/170,566

(22) Filed: Jun. 1, 2016

(65) Prior Publication Data

US 2016/0348395 A1 Dec. 1, 2016

(30) Foreign Application Priority Data

Jun. 1, 2015 (CN) ..... 2015 2 0366027 U
Jul. 22, 2015 (CN) ..... 2015 2 0533842 U

(51) Int. Cl.
*E04H 15/50* (2006.01)
*E04H 15/46* (2006.01)
*E04H 15/26* (2006.01)

(52) U.S. Cl.
CPC ..... *E04H 15/50* (2013.01); *E04H 15/26* (2013.01); *E04H 15/46* (2013.01)

(58) Field of Classification Search
CPC ..... E04H 15/50; E04H 15/46; E04H 15/48; E04H 15/32
See application file for complete search history.

(56) References Cited

U.S. PATENT DOCUMENTS 1,061,547 A 5/1913 Kennedy
1,347,107 A 7/1920 McCann
3,888,056 A 6/1975 Kelly
(Continued)

FOREIGN PATENT DOCUMENTS

CA 2895981 A1 12/2015
CN 2401649 Y 10/2000
(Continued)

OTHER PUBLICATIONS

U.S. Appl. No. 14/762,139, filed Dec. 16, 2015.
(Continued)

*Primary Examiner* — Noah Chandler Hawk
(74) *Attorney, Agent, or Firm* — Morgan, Lewis & Bockius LLP

(57) ABSTRACT

Disclosed are tent frames, and centralized locking and unlocking mechanisms for tent frames. A centralized locking mechanism includes a slider coupled with the first connector movably disposed on a central pole, and a fastening assembly coupled with the slider. The fastening assembly includes a fastener configured to selectively couple the second hole of the slider with the first restricting hole of the central pole and thus restrict the slider from moving along the central pole, and decouple the second hole of the slider from the first restricting hole of the central pole and thus allow the slider to move along the central pole. An unlocking mechanism is disposed at the lower end of the central pole for selectively unlocking the centralized locking mechanism.

23 Claims, 22 Drawing Sheets

(56) References Cited

U.S. PATENT DOCUMENTS 4,286,612 A 9/1981 Neal
4,630,627 A 12/1986 Windows
4,641,676 A 2/1987 Lynch
4,793,371 A 12/1988 O'Ferrell
4,944,321 A 7/1990 Moyet-Ortiz
5,224,507 A 7/1993 Vosse
5,275,188 A * 1/1994 Tsai ..... E04H 15/50 135/145
5,421,356 A 6/1995 Lynch
5,794,640 A * 8/1998 Jang ..... E04H 15/50 135/131
5,813,425 A 9/1998 Carter
5,944,040 A 8/1999 Jang
6,182,917 B1 2/2001 Lai
6,206,020 B1 3/2001 Lynch
6,463,948 B2 10/2002 Lee
6,598,614 B2 * 7/2003 Liu ..... E04H 15/50 135/131
6,708,707 B2 * 3/2004 Dotterweich ..... E04H 15/50 135/131
6,718,995 B2 4/2004 Dotterweich
6,848,461 B2 2/2005 Tsai
6,929,017 B2 * 8/2005 Byun ..... E04H 15/50 135/131
7,055,538 B2 6/2006 Deng
7,240,686 B2 * 7/2007 Seo ..... E04H 15/50 135/131
7,296,584 B2 11/2007 Goldwitz
7,299,813 B2 11/2007 Ochi
7,316,239 B2 1/2008 Yang
7,360,549 B2 * 4/2008 Seo ..... E04H 15/44 135/145
7,395,830 B2 7/2008 Seo
7,422,026 B2 * 9/2008 Kim ..... E04H 15/50 135/120.2
8,220,477 B2 * 7/2012 Park ..... E04H 15/50 135/131
8,544,489 B2 10/2013 Choi
8,616,226 B2 12/2013 Ma
8,701,692 B2 4/2014 Holland
D705,884 S 5/2014 Jin
8,776,816 B2 7/2014 Danziger
8,893,737 B2 11/2014 Yang
8,910,648 B2 12/2014 Jin
9,243,422 B2 1/2016 Hunt
9,528,292 B1 12/2016 Lovley, II
9,580,929 B2 2/2017 Ma
9,739,073 B2 8/2017 Huang
9,869,110 B2 1/2018 Krenzel
9,926,720 B2 3/2018 Huang
2001/0050098 A1 12/2001 Lee
2002/0074032 A1 * 6/2002 Park ..... E04H 15/50 135/131
2004/0144412 A1 7/2004 Tsai
2005/0241688 A1 * 11/2005 Wu ..... E04H 15/48 135/145
2006/0169312 A1 8/2006 Choi
2007/0012347 A1 1/2007 Ochi
2007/0051397 A1 3/2007 Choi
2007/0144572 A1 6/2007 Patel
2007/0221262 A1 9/2007 Tsai
2009/0032079 A1 2/2009 Choi
2010/0043856 A1 2/2010 Yang
2011/0073148 A1 3/2011 Choi
2012/0291830 A1 11/2012 Crimi
2013/0014794 A1 1/2013 Jin
2013/0247948 A1 9/2013 Lovely et al.
2013/0284225 A1 10/2013 Holland
2014/0174491 A1 6/2014 Park
2014/0261601 A1 9/2014 Jin
2014/0261602 A1 9/2014 Ampoyo
2014/0290710 A1 10/2014 Choi
2015/0083177 A1 3/2015 Holes
2015/0247339 A1 9/2015 Lee
2015/0308147 A1 10/2015 Lee
2015/0376913 A1 * 12/2015 Choi ..... E04H 15/50 135/147
2016/0108639 A1 4/2016 Huang
2016/0348392 A1 * 12/2016 Jin ..... E04H 15/02
2017/0121999 A1 5/2017 Ma
2017/0292287 A1 10/2017 Lovley, II
2018/0080242 A1 3/2018 Choi
2018/0080243 A1 3/2018 Choi
2018/0106066 A1 4/2018 Choi
2018/0106067 A1 4/2018 Choi
2018/0106068 A1 4/2018 Choi
2018/0142493 A1 5/2018 Choi

FOREIGN PATENT DOCUMENTS

CN 201202302 Y 3/2009
CN 103590650 B 2/2014
CN 104265063 A 1/2015
CN 104358468 A 2/2015
CN 204163467 U 2/2015
FR 1 121 851 8/1956
FR 68588 5/1958
JP 4557885 B2 10/2010
WO WO 2010104939 A1 9/2010
WO WO 2011/022764 A1 3/2011
WO WO 2013/116545 A1 8/2013

OTHER PUBLICATIONS

U.S. Appl. No. 14/753,989, filed Jun. 29, 2015.
U.S. Appl. No. 14/280,845, filed May 19, 2014.
U.S. Appl. No. 14/292,024, filed May 30, 2014.
U.S. Appl. No. 15/080,316, filed Mar. 24, 2016.
U.S. Appl. No. 14/910,979, filed Jun. 28, 2016.
U.S. Appl. No. 14/998,549, filed Dec. 24, 2015.
U.S. Appl. No. 15/170,587, filed Jun. 1, 2016.
U.S. Appl. No. 15/217,835, filed Jul. 22, 2016.
Design U.S. Appl. No. 29/600,927, filed Apr. 17, 2017.
Design U.S. Appl. No. 29/600,929, filed Apr. 17, 2017.
U.S. Appl. No. 15/709,222, filed Sep. 19, 2017.
U.S. Appl. No. 15/709,234, filed Sep. 19, 2017.
U.S. Appl. No. 15/782,699, filed Oct. 13, 2017.
U.S. Appl. No. 15/782,717, filed Oct. 12, 2017.
U.S. Appl. No. 15/782,726, filed Oct. 12, 2017.
U.S. Appl. No. 15/821,019, filed Nov. 22, 2017.

* cited by examiner

CENTRALIZED LOCKING AND UNLOCKING MECHANISMS FOR TENT FRAMES AND TENT FRAMES HAVING SAME

CROSS-REFERENCE TO RELATED APPLICATIONS

The present application claims priority of Chinese Utility Model Applications CN 201520366027.2 filed on Jun. 1, 2015, and CN 201520533842.3 filed on Jul. 22, 2015, the entire contents of which application are incorporated herein for all purposes by this reference.

FIELD OF THE INVENTION

The present invention generally relates to tent frames and mechanisms for tent frames. More particularly, the present invention relates to centralized locking and unlocking mechanisms for tent frames and tent frames having centralized locking and unlocking mechanisms.

BACKGROUND

Existing tent frames in general have locking mechanisms configured and installed at each of the supporting poles. For example, FIG. 1 shows an existing tent frame including supporting poles 101 connected to central pole 102 through upper connecting units 103. Adjacent supporting poles 101 are connected to each other through side connecting unit 104. Connector 111 and locking mechanism 111*a* are slidably disposed on each supporting pole 101, with locking mechanism 111*a* below connector 111.

Folding and unfolding such a tent frame is cumbersome. For example, to unfold the tent frame, it is required to place each supporting pole 101 upright at a predetermined position. It is also required to push each connector 111, along with locking mechanism 111*a*, upward on each supporting pole 101, and then use locking mechanism 111*a* to fix each connector 111 on each supporting pole 101. To fold the tent frame, it is required to release locking mechanism 111*a* and move each connector 111 downward along each supporting pole 101. In some cases where supporting pole 101 is long (or tall), each supporting pole 101 is required to be retracted to reduce its length in order to release locking mechanism 111*a* or pull each connector 111 downward.

In addition to inconvenience for use, locking mechanisms configured and installed at each supporting pole also increase the cost of the tent frame.

Given the current state of the art, there remains a need for locking and unlocking mechanisms, and tent frames that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide tent frames and mechanisms that facilitate easy folding and unfolding of the tent frames and reduce the cost of the tent frames.

In some embodiments, the present invention provides a tent frame including a central pole, a first connector, a second connector, a plurality of supporting poles, a plurality of third connectors, a plurality of fourth connectors, one or more upper connecting units, and a centralized locking mechanism. The first connector is movably coupled with the central pole. The second connector is fixedly coupled with a lower end of the central pole. Each of the plurality of third connectors is movably coupled with a corresponding supporting pole. Each of the fourth connectors is fixedly coupled with an upper end of a corresponding supporting pole. Each of the one or more upper connecting units is pivotally connected to the first and second connectors disposed at the central pole, and pivotally connected to the third and fourth connectors disposed at a corresponding supporting pole. The centralized locking mechanism is configured to selectively restrict the first connector from moving along the central pole thereby holding the tent frame in an unfolded state, or release the restriction thereby allowing the tent frame to fold. In an embodiment, each upper connecting unit includes one or more upper pole pairs. Each upper pole pair includes two upper poles pivotally connected to each other and forming an "X" shape when unfolded. Ends of adjacent upper pole pairs in each upper connecting unit are pivotally connected to each other.

In some embodiments, the tent frame further includes one or more of the following: one or more side connecting units, a plurality of oblique poles, and an auxiliary mechanism. Each side connecting unit is disposed between two adjacent supporting poles and has two ends pivotally connected to the fourth connectors that are fixedly coupled with the two adjacent supporting poles. Each oblique pole pivotally connected to the side connecting unit that is connected to the corresponding supporting pole, and each oblique pole has one end pivotally connected to the third connector that is movably coupled with a corresponding supporting pole. The auxiliary mechanism assists in folding and unfolding of the tent frame and includes an auxiliary connector, a second elastic member, and a plurality of auxiliary poles. The auxiliary connector is slidably disposed on the central pole between the first connector and the centralized locking mechanism. The second elastic member is slidably disposed on the central pole between the first connector and the auxiliary connector. Each auxiliary pole has one end pivotally connected to the auxiliary connector and the other end pivotally connected to a corresponding upper connecting unit.

In an exemplary embodiment, at least one side connecting unit includes two or more side poles pivotally connected to each other. In an embodiment, each oblique pole is pivotally connected to the side pole that is connected to the corresponding supporting pole, such that a portion of the oblique pole is extended obliquely upward from the side pole when unfolded.

In an exemplary embodiment, at least one side connecting unit includes two or more side pole pairs. Each side pole pair includes two side poles pivotally connected to each other and forming an "X" shape when unfolded. Adjacent side pole pairs are pivotally connected to each other at ends of corresponding side poles. Side poles at both ends of the side connecting unit are pivotally connected to the third and fourth connectors at adjacent supporting poles.

In an exemplary embodiment, a tent frame includes one or more first side connecting units, and one or more second side connecting units different than the first side connecting unit. In one embodiment, each of the one or more first side connecting units is connected to adjacent supporting poles along a longitudinal direction of the tent frame and includes two or more side pole pairs. Each of the one or more second side connecting units is connected to adjacent supporting poles along a lateral direction of the tent frame and includes two or more side poles pivotally connected to each other at their ends.

In some embodiments, the present invention provides a tent frame assembly including two or more tent frames of the present invention coupled to each other, where adjacent tent frames share one or more supporting poles.

In some embodiments, the present invention provides a centralized locking mechanism for a tent frame. The centralized locking mechanism includes a slider and a fastening assembly. The slider is coupled with the first connector and includes first and second holes. The first hole is formed in an axial direction to allow the central pole passing through and to allow the slider movable along the central pole, and the second hole is formed in a transverse direction and intersecting with the first hole. The fastening assembly is coupled with the slider, and includes a fastener. The fastener is configured to selectively couple the second hole of the slider with a first restricting hole of the central pole, thereby restricting the slider from moving along the central pole, and decouple the second hole of the slider from the first restricting hole of the central pole, thereby allowing the slider to move along the central pole. In an embodiment, the slider is monolithically formed or fixedly coupled with the first connector.

In some embodiments, the slider further includes a receiving space for receiving the fastener of the fastening assembly. The fastener has first and second ends, with the first end toward the first hole of the slider and configured to be selectively inserted into or released from the first restricting hole of the central pole. In one embodiment, the fastening assembly further includes a first pulling element connected to the second end of the fastener. In an embodiment, the fastening assembly further includes: a restricting block disposed at or formed with the fastener adjacent the second end of the fastener; a protruded ring disposed at or formed with the fastener adjacent the first end of the fastener; and an elastic member disposed on the fastener and having one end abutting the protruded ring and the other end abutting the restricting block. In an embodiment, the fastening assembly further includes a fastening means to fix the restricting block on the slider.

In some embodiments, the slider further includes a receiving space formed above the second hole of the slider. The fastening assembly further includes a linking lever pivotally connected to the slider at a location between the second hole and the receiving space; an upper portion of the linking lever is received in the receiving space of the slider. The fastener has first and second ends, with the first end to be selectively inserted into or released from the first restricting hole of the central pole, and the second end connected to a lower portion of the linking lever. In one embodiment, the slider further includes a protruded pillar formed in the receiving space. The fastening assembly further includes an elastic member disposed between the upper portion of the linking lever and the protruded pillar of the slider. The elastic member pushes the upper portion of the linking lever away from the central pole, thereby inserting the fastener into the first restricting hole of the central hole. In an embodiment, the upper portion of the linking lever severs as or is formed with a push button. Pressing the push button toward the central pole releases the fastener from the first restricting hole of the central hole.

In some embodiments, the fastener is an elastic clip disposed inside of the central pole, and includes a protruded section configured to be selectively protruded out of the first restricting hole of the central pole and into the second hole of the slider, thereby coupling the slider with the central pole and restricting the slider and the first connector from moving along the central pole. In one embodiment, the slider further includes a receiving space distal from the first hole of the slider. The fastening assembly further includes a push button received in the receiving space of the slider and movably coupled with the slider. Pressing the push button toward the central pole releases the protruded section of the fastener from the second hole of the slider, thereby decoupling the slider from the central pole, and allowing the slider and the first connector to move along the central pole. In an embodiment, the push button is movably coupled with the slider through one or more pin holes formed on the slider and one or more corresponding elongated grooves formed on the push bottom along the transverse direction.

In some embodiments, the present invention provides an unlocking mechanism for a centralized locking mechanism. The unlocking mechanism includes a second pulling element, a third elastic member, and a pull pole slidably disposed in the central pole. The pull pole includes a recessed neck formed at a lower end portion of the pull pole, and a recessed groove formed at an upper portion of the pull pole and corresponding to the first restricting hole of the central pole. The lower end of the recessed neck passes through the second connector and connected to the second pulling element. The third elastic member is disposed on the recessed neck inside the second connector. At least one surface of the recessed groove is oblique with respect to a longitudinal direction of the central pole. The fastener of the centralized locking mechanism is configured to be selectively inserted into the recessed groove of the pull pole and the first restricting hole of the central pole to restrict the slider and the first connector from moving along the central pole, and to be selectively retrieved from the recessed groove of the pull pole and the restricting hole of the central pole to allow the slider and the first connector to move along the central pole.

In an exemplary embodiment, the second connector is formed with a hole to allow the lower end of the recessed neck passes through, the hole has a narrowed bottom, wherein the third elastic member has one end abutting the narrowed bottom of the hole and the other end abutting a shoulder formed by the recessed neck of the pull pole. In an embodiment, the pull pole further includes one or more elongated slots formed between the recessed neck and the recessed groove. The central pole includes one or more additional restricting holes formed on its peripheral wall and corresponding to the one or more elongated slots. The unlocking mechanism further includes one or more pins slidably coupling the one or more elongated slots with the one or more additional restricting holes, thereby limiting a moving distance of the pull pole.

Exemplary systems of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
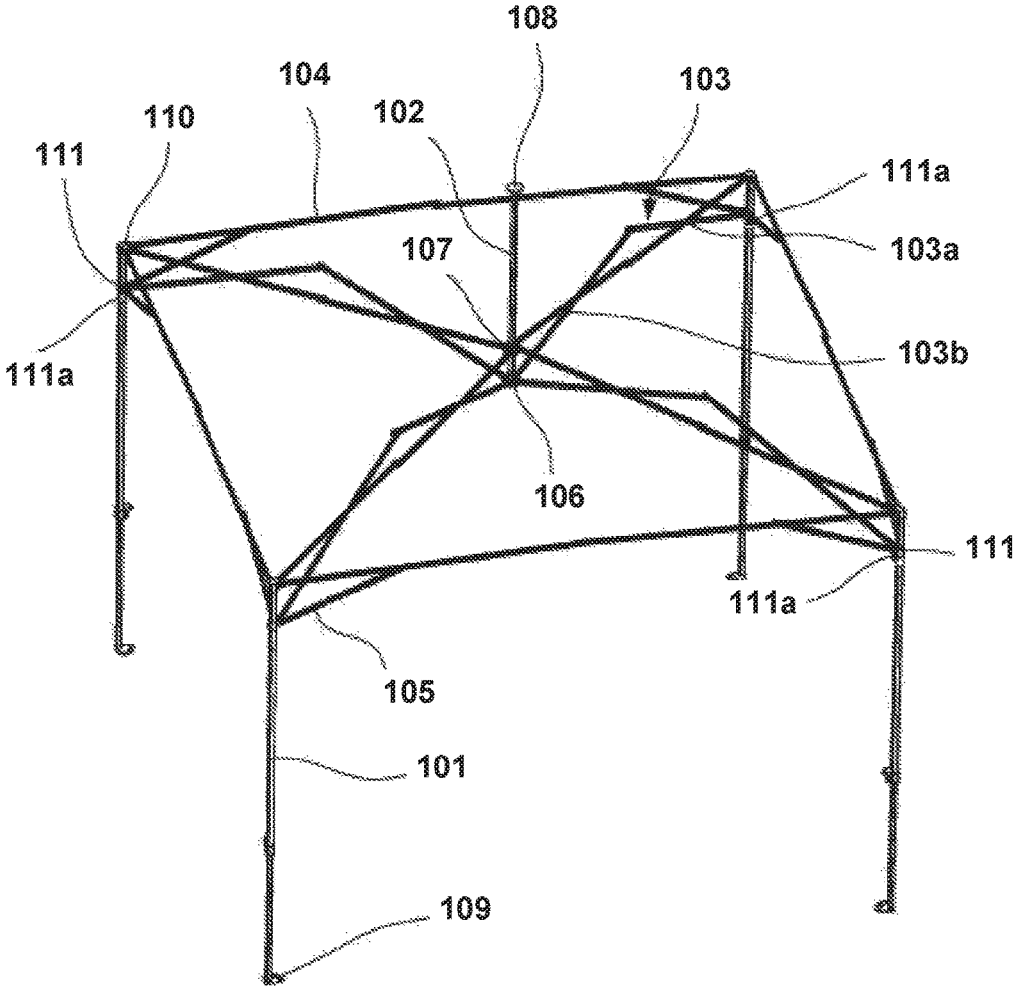
FIG. 1 (Related Art)
FIG. 1 is a schematic view illustrating a tent frame of related art.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of tent frames, and mechanisms for tent frames. Generally, a tent frame of the present invention includes a central pole, a plurality of supporting poles, and one or more connecting units each coupled to the connectors disposed at the central pole and a corresponding supporting pole. A tent frame of the present invention also includes a centralized locking mechanism disposed at the central pole and configured to selectively hold the tent frame in an unfolded state or allow the tent frame to fold. The centralized locking mechanism functions as one centralized key in folding and unfolding of the tent frame. It eliminates the needs of multiple individual locking mechanisms as in the conventional tent frames, and thus makes the use of the tent frame simple and effective. In addition, it reduces the cost of the tent frames. In some embodiments, a tent frame of the present invention further includes an unlocking mechanism for unlocking the centralized locking mechanism. The unlocking mechanism is easily accessible, making the tent frame of the present invention even more convenient to use.

A tent frame of the present invention can be of various sizes and shapes. It can include various number of supporting poles such as three, four, five or more supporting poles and various number of connecting units such as three, four, five or more connecting units. The central pole can be, but not necessarily need to be, the center or in the middle of the tent frame. In addition, two or more tent frames of the present invention can also be assembled together to form a tent frame assembly.

Referring now to FIGS. 2, 7, 10 and 20, a tent frame of the present invention includes a central pole such as central pole 2 and a plurality of supporting poles such as four supporting poles 1 in the illustrated embodiments. The tent frame also includes a first connector such as first connector 7 movably coupled with central pole 2, and a second connector such as second connector 6 fixedly coupled with central pole 2 at the lower end of central pole 2. For each supporting pole 1, the tent frame includes a third connector such as third connector 11 movably coupled with the supporting pole, and a fourth connector such as fourth connector 10 fixedly coupled with the supporting pole at the upper end of the supporting pole. An upper connecting unit such as upper connecting unit 3 is disposed between central pole 2 and one supporting pole 1, and in some cases, one upper connecting unit 3 is disposed between central pole 2 and each supporting pole 1. Upper connecting unit 3 is pivotally connected to the first and second connectors disposed at the central pole, and pivotally connected to the third and fourth connectors disposed at the supporting pole. The tent frame further includes a centralized locking mechanism (e.g., 9, 9A, 9B) configured to selectively restrict the first connector from moving along the central pole thereby holding the tent frame in an unfolded state, or release the restriction thereby allowing the tent frame to fold.

Figure 2:
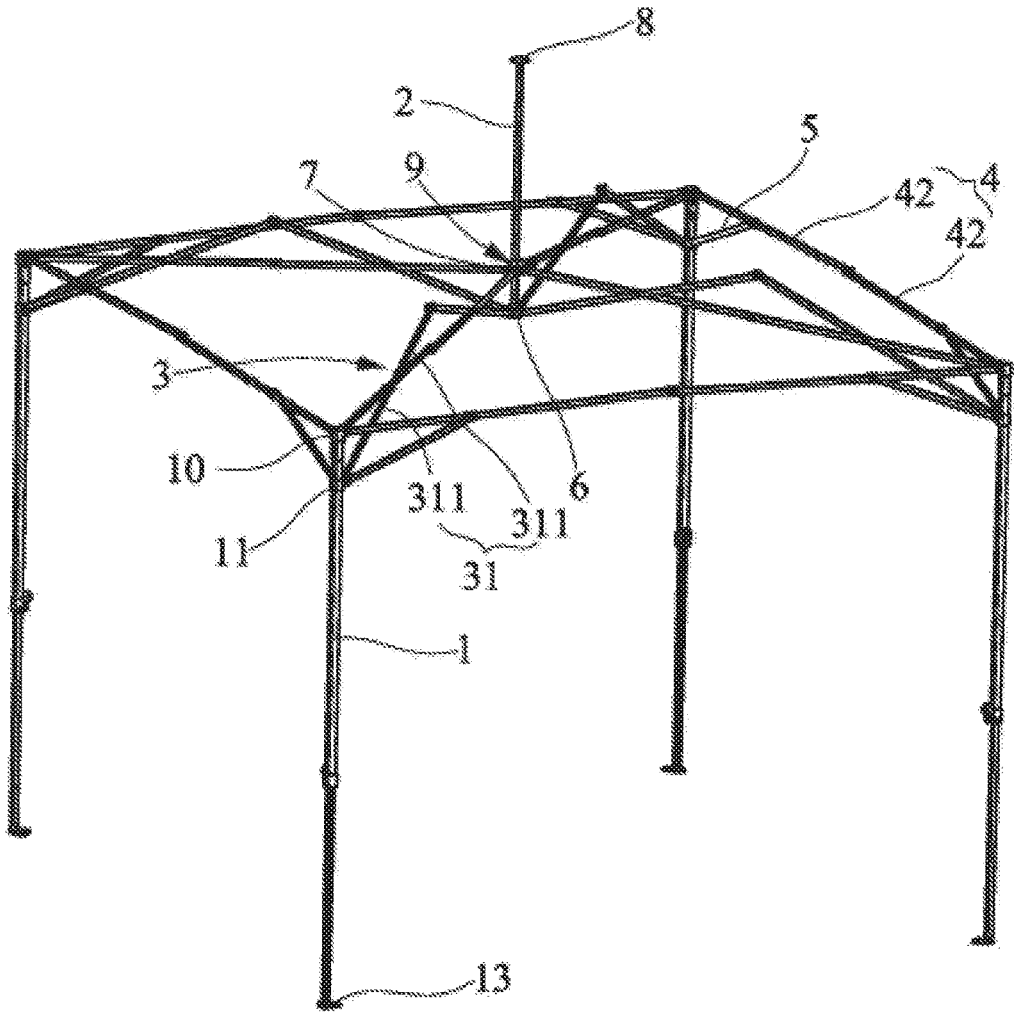
FIG. 2 is a schematic view illustrating a tent frame having a first exemplary centralized locking mechanism in an unfolded state in accordance with exemplary embodiments of the present invention.

In some embodiments, each upper connecting unit 3 includes an upper pole pair such as upper pole pair 31. Upper pole pair 31 includes two upper poles 311 pivotally connected to each other. When unfolded, the two upper poles form an "X" shape. In some embodiments, one or each upper connecting unit includes two or more upper pairs 31. In such embodiments, ends of adjacent upper pole pairs of the same upper connecting unit are pivotally connected to each other. For example, FIG. 2 illustrates each upper connecting unit 3 including two upper pairs 31, with each upper pair 31 having two upper poles 311. Ends of the two upper poles of one upper pair are pivotally connected to ends of the two upper poles of the other upper pair. It should be noted that the number of upper pole pairs in one connecting unit can be the same as or different from that in another connecting unit.

In some embodiments, the tent frame of the present invention also includes one or more side connecting units such as side connecting unit 4. Each side connecting unit 4 is disposed between two adjacent supporting poles 1 and connected to fourth connectors 10 that are fixedly coupled with the two adjacent supporting poles. In an embodiment such as the one illustrated in FIG. 2, side connecting unit 4 includes two side poles 42, each having an end pivotally connected to an end of the other side pole and having another end pivotally connected to fourth connector 10 that is fixedly coupled with a corresponding supporting pole. In another embodiment, side connecting unit 4 includes three, four or more side poles pivotally connected to each other at their corresponding ends.

Figure 14:
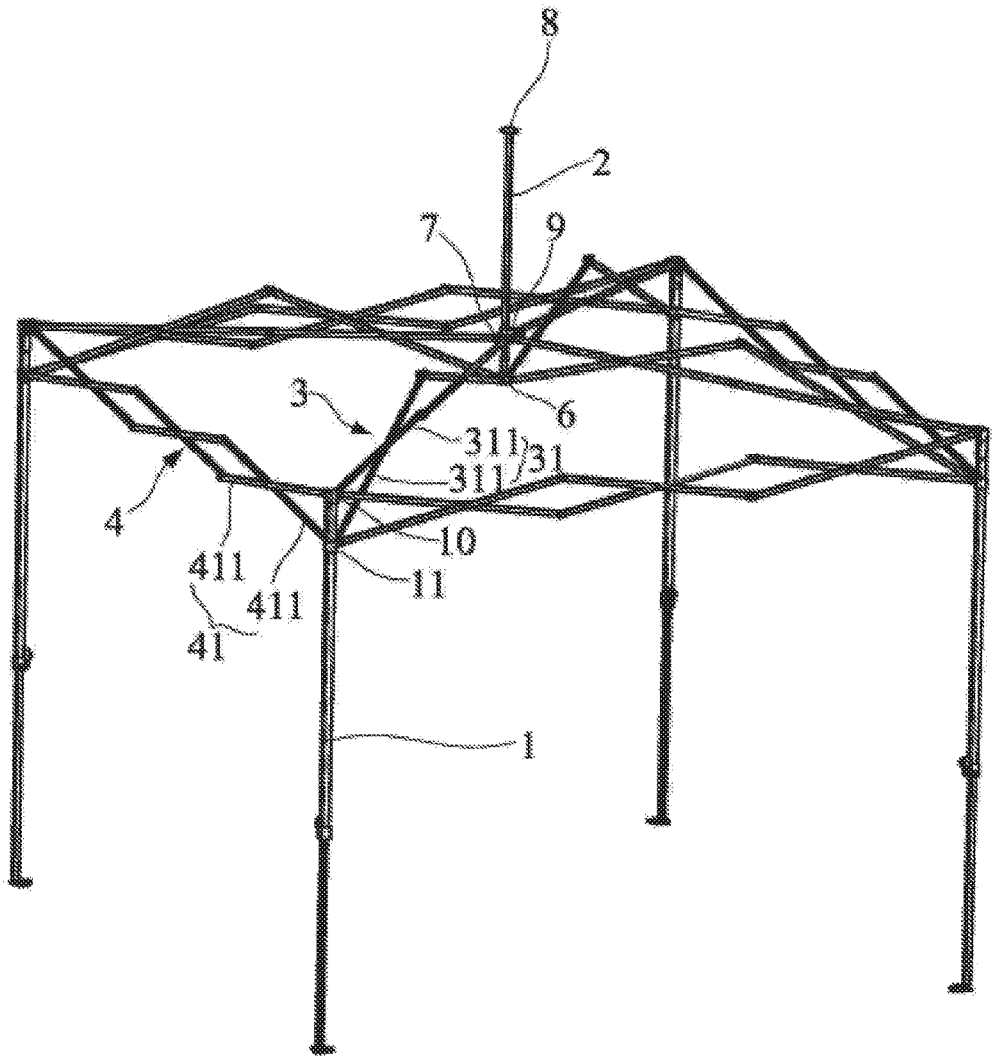
FIG. 14 is a schematic view illustrating a tent frame in an unfolded state in accordance with exemplary embodiments of the present invention.

In an embodiment, at least one side connecting unit includes two or more side pole pairs. For example, FIG. 14 illustrates each side connecting unit 4 includes two side pole pairs 41. Each side pole pair includes two side poles 411 pivotally connected to each other and forming an "X" shape when unfolded. Within one side connecting unit, ends of adjacent side pole pairs are pivotally connected to each other, and side poles at both ends of the side connecting unit are pivotally connected to the corresponding third and fourth connectors that are coupled to adjacent supporting poles.

Figure 13:
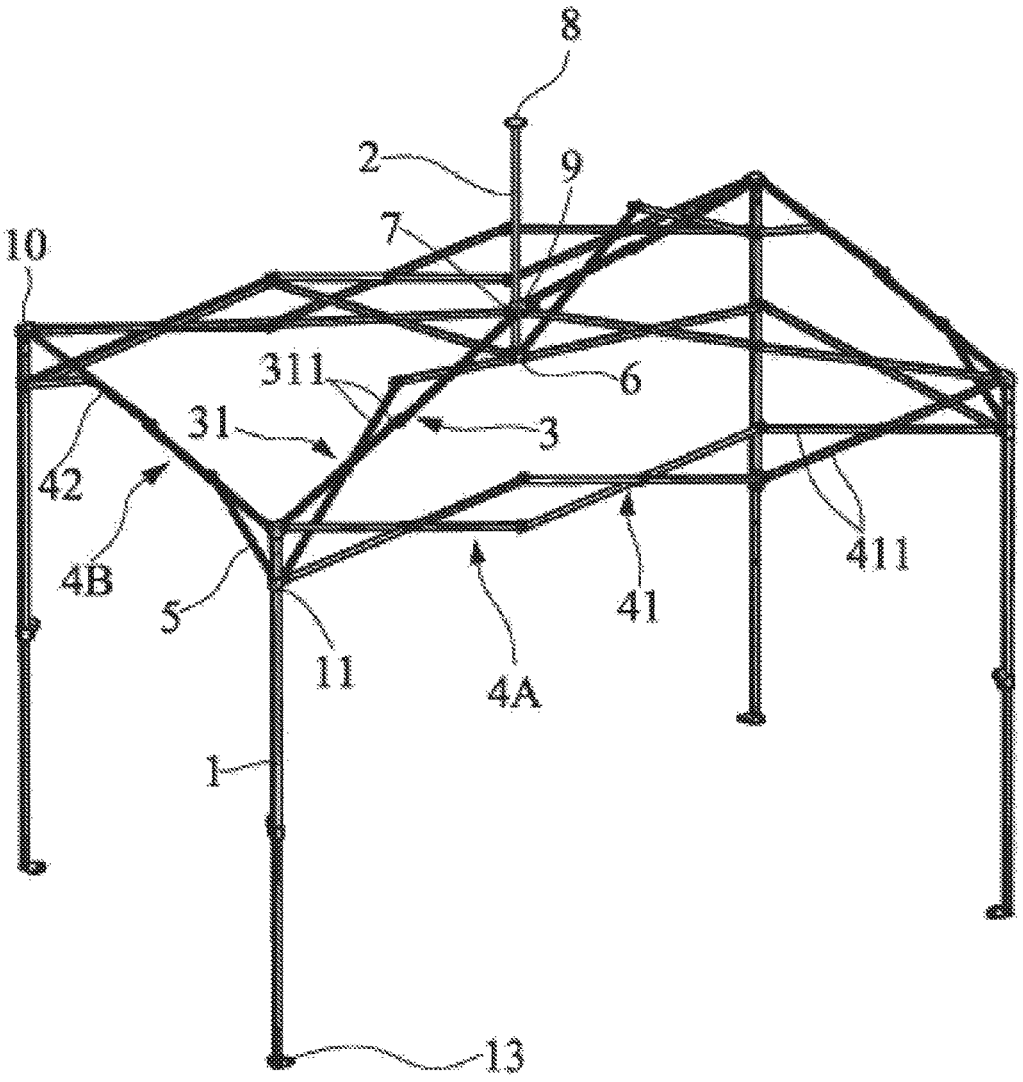
FIG. 13 is a schematic view illustrating a tent frame in an unfolded state in accordance with exemplary embodiments of the present invention.

In some embodiments, the tent frame includes two or more different side connecting units. For example, FIG. 13 illustrates a first side connecting unit such as side connecting unit 4A connected to adjacent supporting poles along a longitudinal direction of the tent frame, and a second connecting unit such as side connecting unit 4B connected to adjacent supporting poles along a lateral direction of the tent frame. By way of illustration, FIG. 13 shows first side connecting unit 4A the same as or similar to the side connecting unit of FIG. 14, and second side connecting unit 4B the same as or similar to the side connecting unit of FIG. 2 as disclosed herein.

Figure 16:
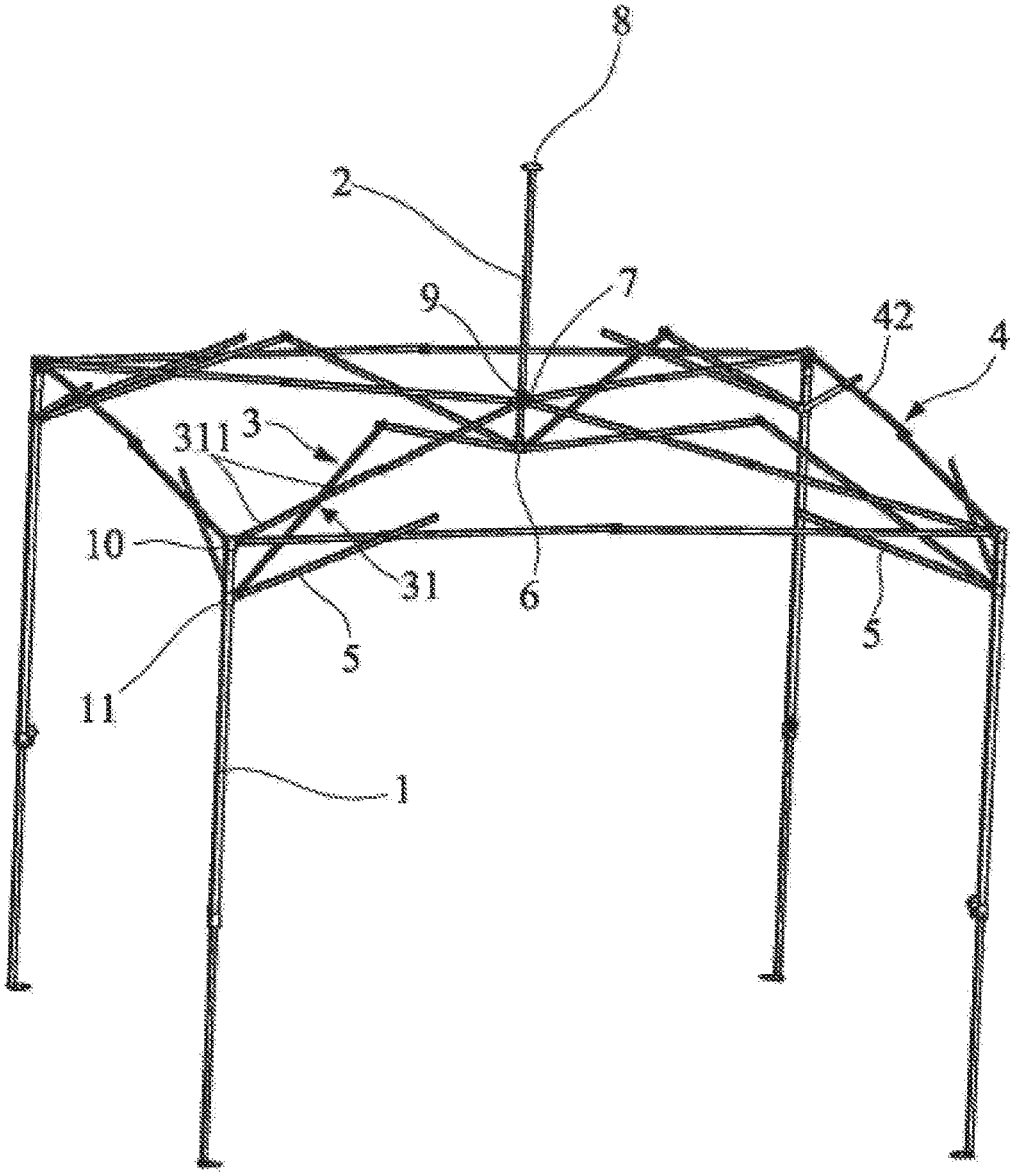
FIG. 16 is a schematic view illustrating a tent frame in an unfolded state in accordance with exemplary embodiments of the present invention.

In some embodiments, the tent frame of the present invention also includes a plurality of oblique poles such as oblique pole 5. Oblique pole 5 is pivotally connected to third connector 11 that is movably coupled with a corresponding supporting pole and pivotally connected to side connecting unit 4, for example, connected to side pole 42 that is connected to the fourth connector at the corresponding supporting pole. In an embodiment such as the one illustrated in FIG. 16, oblique pole 5 is connected to side pole 42 in a way such that a portion of oblique pole 5 is extended obliquely upward from the side pole when unfolded. When a tent cloth is placed on the tent frame, it is partially supported by the extended portions of oblique poles 5. On rainy days, a general V-shape channel is formed in the tent cloth between the extended portions, facilitating water drainage and preventing water accumulation in raining days.

In some embodiments, the tent frame of the present invention also includes a supporting member such as supporting member 8 coupled to or formed at the upper end of the central pole. Supporting member 8 can be used for supporting a tent cloth. In some embodiments, the tent frame of the present invention also includes a plurality of bases or pins 13 coupled to or formed at the lower ends of supporting poles 1.

Figure 15:
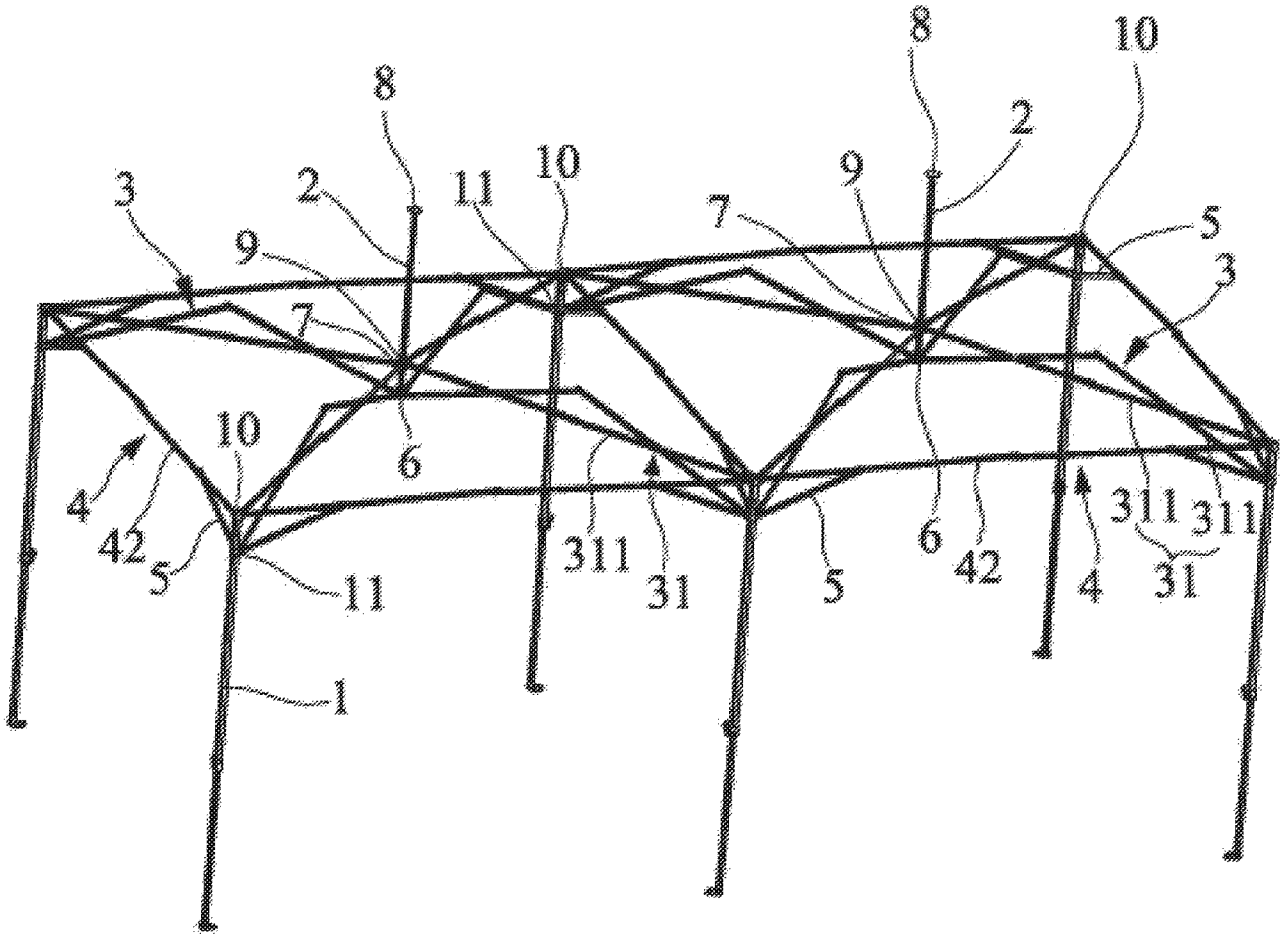
FIG. 15 is a schematic view illustrating a tent frame assembly in an unfolded state in accordance with exemplary embodiments of the present invention.

In some embodiments, two or more tent frames of the present invention are coupled to each other to form a tent frame assembly. In such embodiments, adjacent tent frames share one or more supporting poles. For example, FIG. 15 illustrates a tent frame assembly including two tent frames disposed side by side and sharing two supporting poles 1. It should be noted that any tent frames disclosed herein can be used to form a tent frame assembly, and do not necessarily need to be identical to each other.

Figure 3:
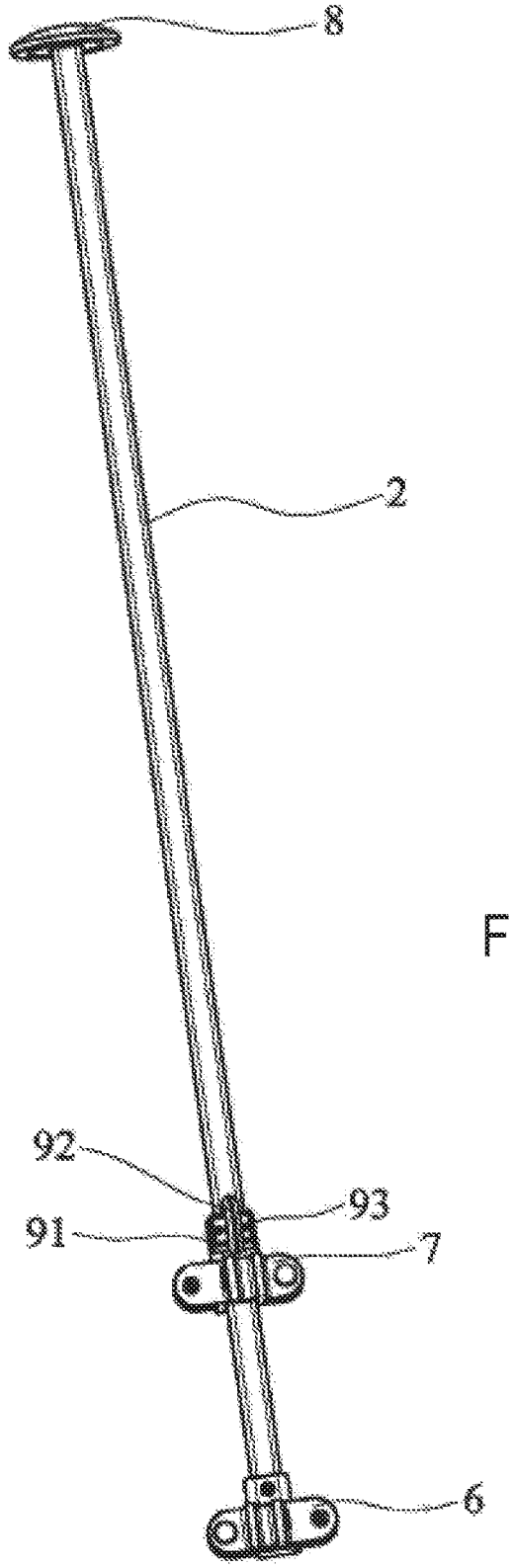
FIG. 3 is a schematic view illustrating the first exemplary centralized locking mechanism in accordance with exemplary embodiments of the present invention.
Figure 4:
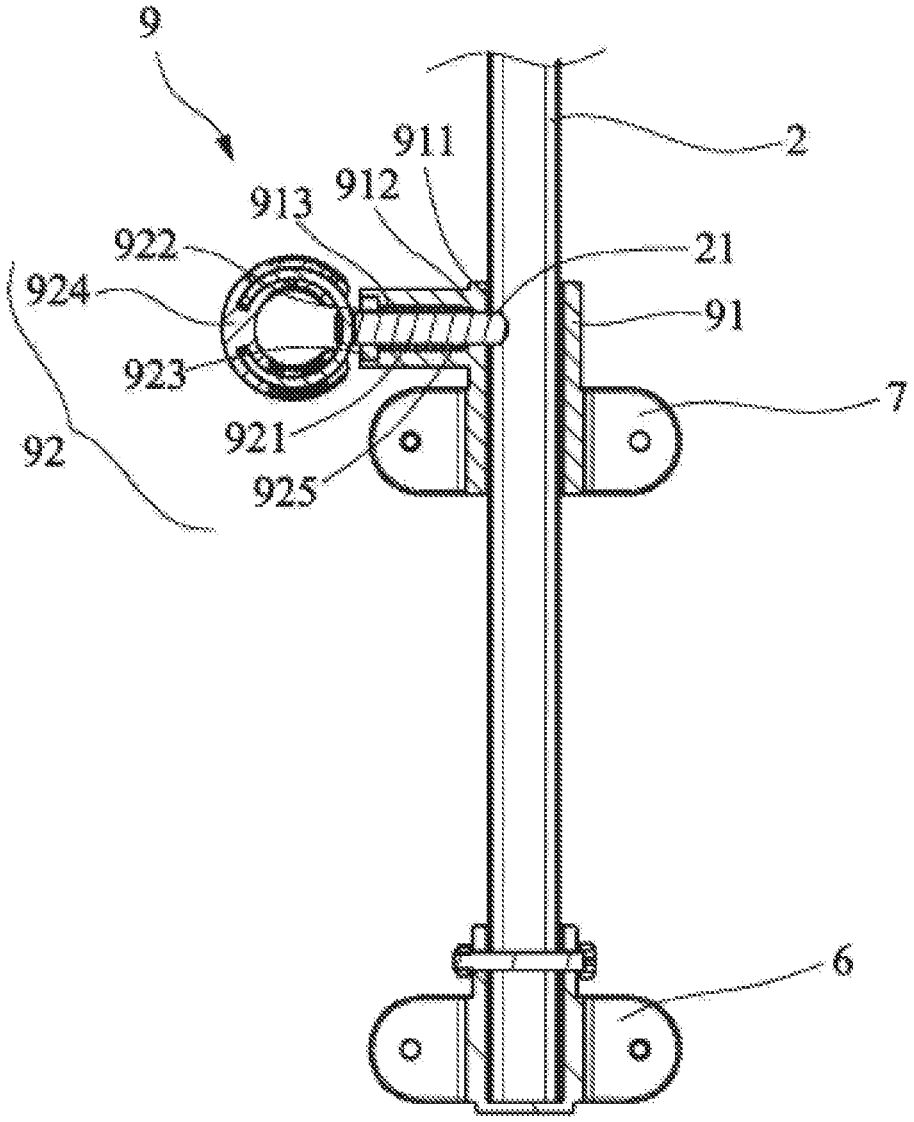
FIG. 4 is a cross-sectional view illustrating the first exemplary centralized locking mechanism in accordance with exemplary embodiments of the present invention.
Figure 5:
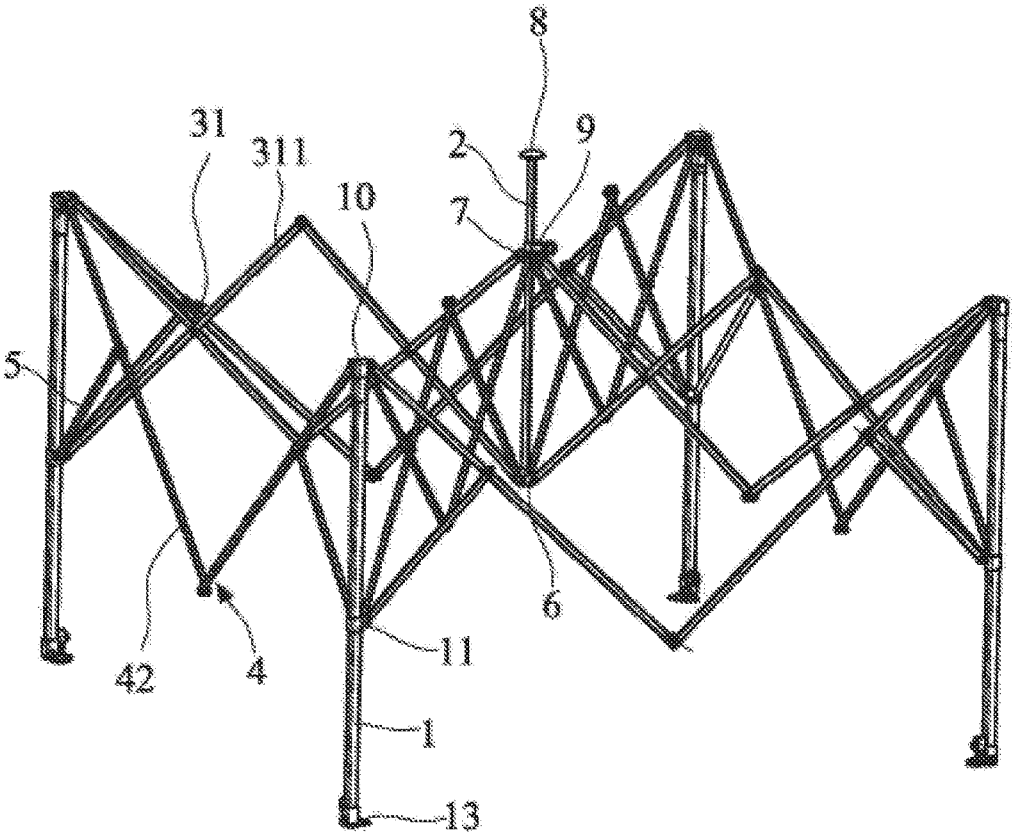
FIG. 5 is a schematic view illustrating the tent frame of FIG. 2 in a partially folded state.
Figure 6:
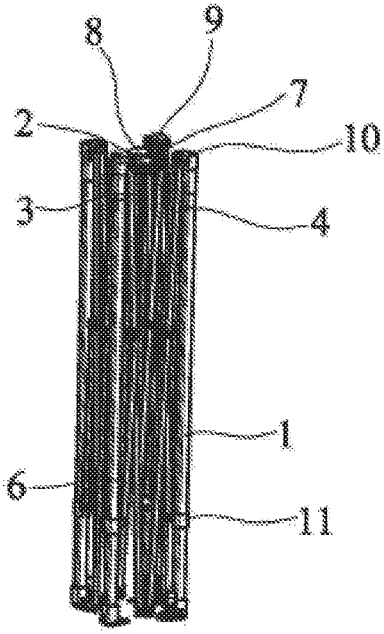
FIG. 6 is a schematic view illustrating the tent frame of FIG. 2 in a folded state.

Turning now to FIGS. 2-6 and in particular to FIGS. 3 and 4, there is depicted a tent frame having first exemplary centralized locking mechanism 9 in accordance with some exemplary embodiments of the present invention. As shown, central pole 2 is formed with a first restricting hole such as first fixation hole 21 on its peripheral wall. First exemplary centralized locking mechanism 9 includes a slider such as slider 91 and a fastening assembly such as fastening assembly 92 coupled with slider 91. In some embodiments, slider 91 is monolithically formed or fixedly coupled with first connector 7. Slider 91 includes a first hole such as first hole 911 and a second hole such as second hole 912. First hole 911 is formed in an axial direction to allow the central pole pass through and to allow the slider movably along the central pole. Second hole 912 is formed in a transverse direction and intersects first hole 911. Fastening assembly 92 includes a fastener such as fastener 921 (e.g., plug or pin). Fastening assembly 92 is configured such that fastener 921 can selectively couple the second hole of the slider with the first restricting hole of the central pole, thereby restricting the slider from moving along the central pole, or decouple the second hole of the slider from the first restricting hole of the central pole, thereby allowing the slider to move along the central pole.

In some embodiments, slider 91 includes a receiving space such as receiving space 913 for receiving fastener 921 of the fastening assembly. Receiving space 913 is formed on the other side of second hole 912 with respect to first hole 911 and forms a step with second hole 912. Fastener 921 has first and second ends, and is received in receiving space 913 with the first end toward first hole 911 of the slider. Insertion of fastener 921 (e.g., the first end) into first restricting hole 21 of the central pole restricts the movement of the slider and the first connector along the central pole.

In some embodiments, fastening assembly 92 further includes a first pulling element such as first pull ring 924 connected to the second end of fastener 921. In some embodiments, fastening assembly 92 further includes a restricting block such as restricting block 923, a protruded ring such as protruded ring 925, and an elastic member such as elastic member 922. Restricting block 923 is disposed at or formed with fastener 921 adjacent the second end of the fastener. Protruded ring 925 is disposed at or formed with fastener 921 adjacent the first end of the fastener. Elastic member 922 is disposed on the fastener and having one end abutting the protruded ring and the other end abutting the restricting block. In some embodiments, fastening assembly 92 further includes a fastening means, such as bolt 93 illustrated in FIG. 3, to fix restricting block 923 on slider 91.

As poles (e.g., supporting poles, upper poles, and side poles) are coupled to each other and ultimately coupled to the centralized locking mechanism, folding and unfolding the tent frame of the present invention can be achieved by operating the centralized locking mechanism. For example, to unfold a tent frame with first exemplary centralized locking mechanism 9, simply move slider 91 (or first connector 7) along the central pole toward second connect 6. When second hole 912 of the slider is aligned with first restricting hole 21 of the central pole, fastener 921 of fastening assembly 92 is pushed by elastic member 922 and inserted into first restricting hole 21 of the central pole, holding the tent frame in an unfolded state. To fold the tent frame, release fastener 921 of fastening assembly 92 from first restricting hole 21 of the central pole, e.g., by pulling first pull ring 924 outwardly, and move slider 91 (together with first connector 7) along the central pole away from second connect 6 (e.g., upward). This movement of the slider and the first connector pulls the upper connecting units, the supporting poles, and the side connecting units toward the central pole and folded onto the central pole.

Figure 7:
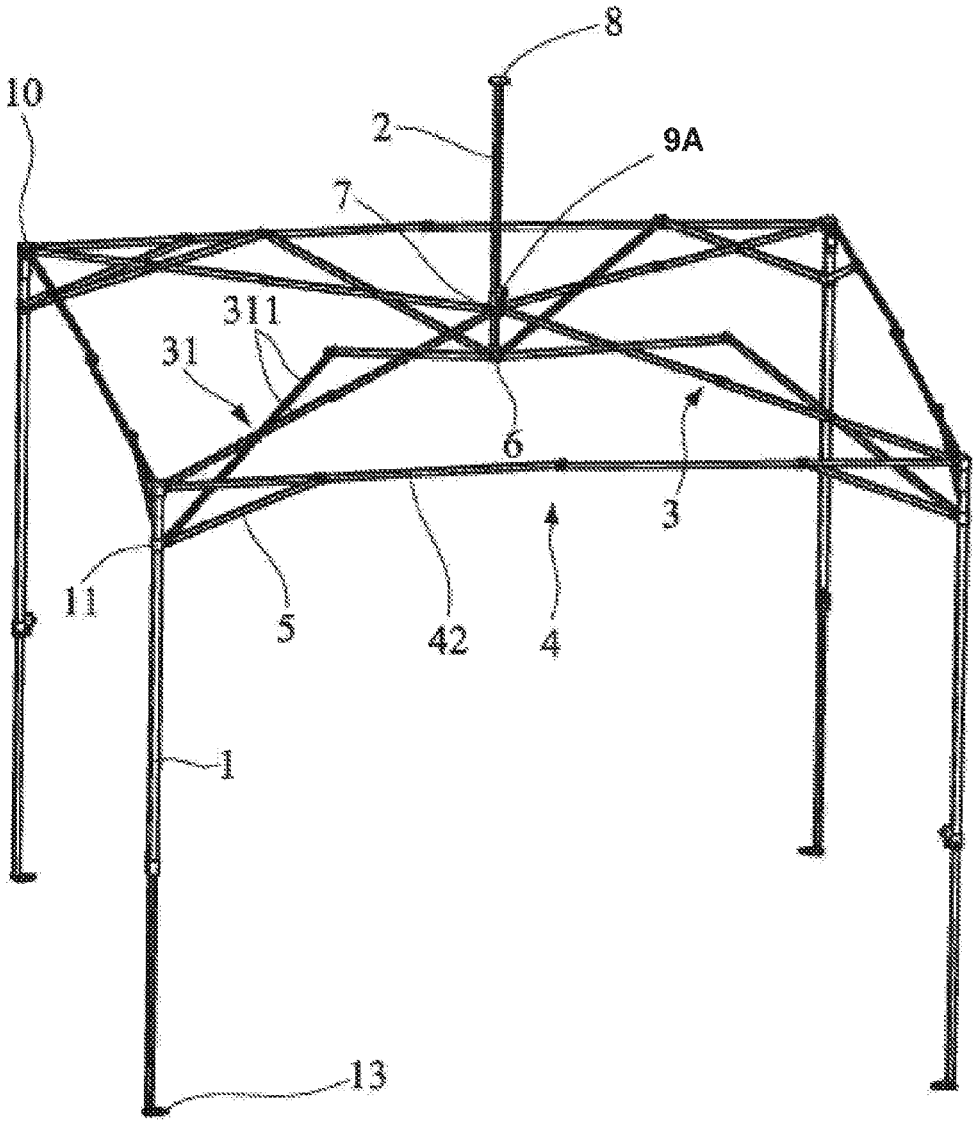
FIG. 7 is a schematic view illustrating a tent frame having a second exemplary centralized locking mechanism in an unfolded state in accordance with exemplary embodiments of the present invention.
Figure 8:
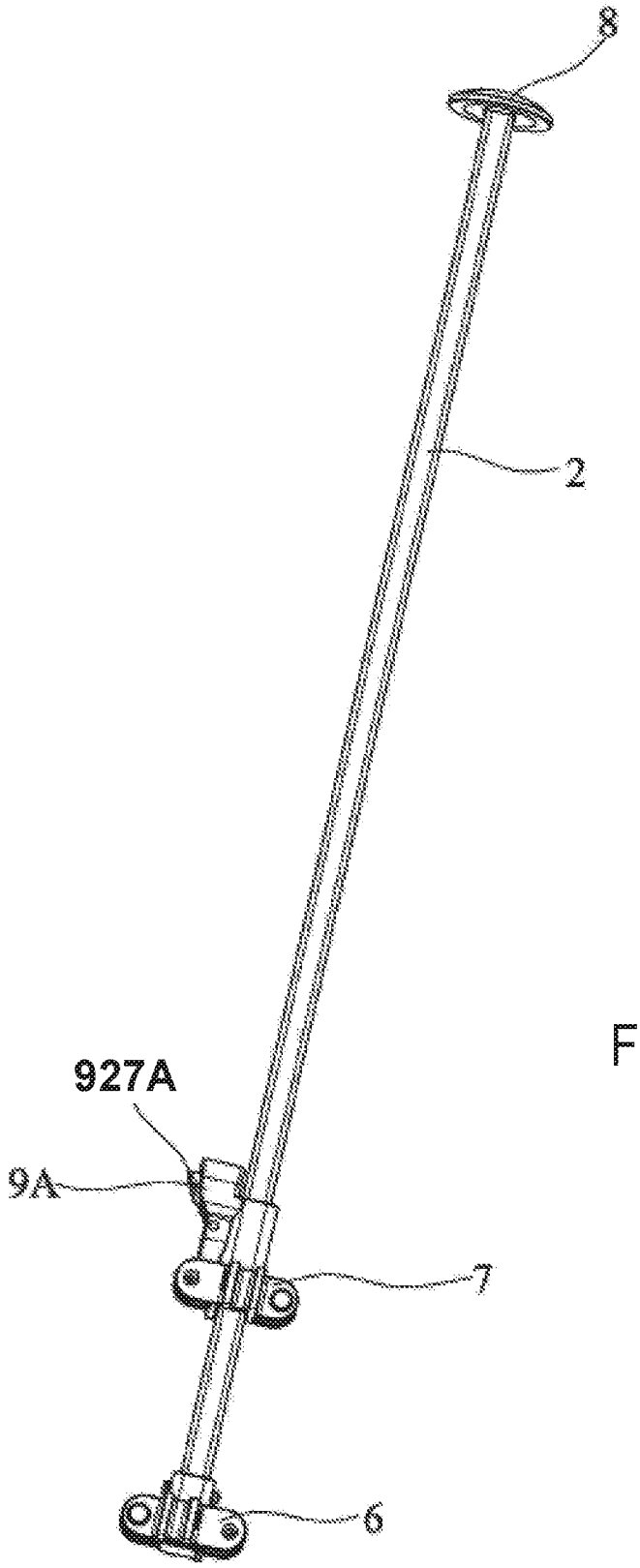
FIG. 8 is a schematic view illustrating the second exemplary centralized locking mechanism in accordance with exemplary embodiments of the present invention.
Figure 9:
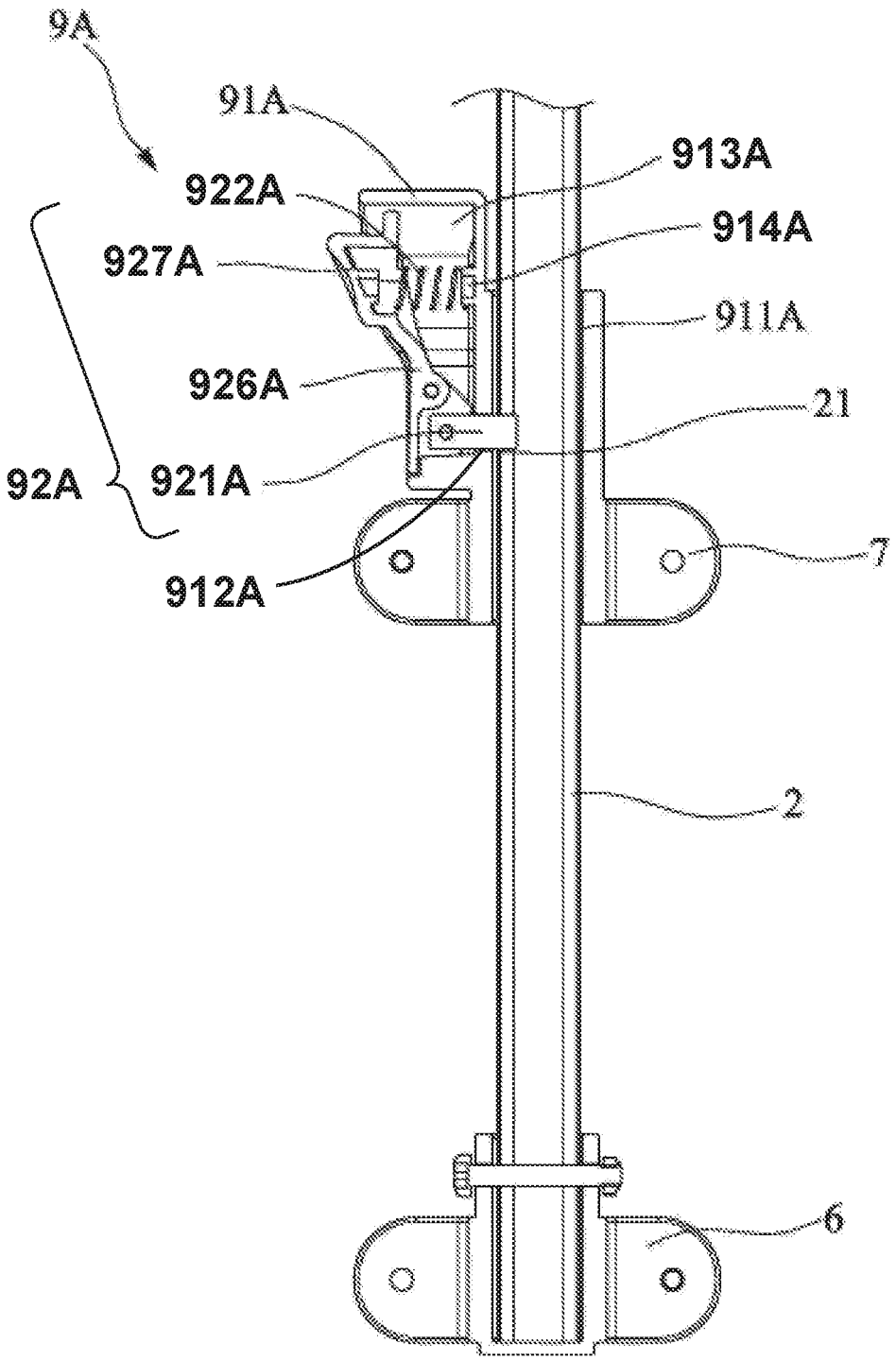
FIG. 9 is a cross-sectional view illustrating the second exemplary centralized locking mechanism in accordance with exemplary embodiments of the present invention.

Referring to FIGS. 7-9, there depicts a tent frame having second exemplary centralized locking mechanism 9A in accordance with some exemplary embodiments of the present invention. Similar to first exemplary centralized locking mechanism 9, second exemplary centralized locking mechanism 9A includes a slider such as slider 91A and a fastening assembly such as fastening assembly 92A coupled with slider 91A. Slider 91A is monolithically formed or fixedly coupled with first connector 7. It includes a first hole such as first hole 911A and a second hole such as second hole 912A. First hole 911A is formed in an axial direction to allow the central pole pass through and to allow the slider movably along the central pole. Second hole 912A is formed in a transverse direction and intersects first hole 911. Fastening assembly 92A includes a fastener such as fastener 921A (e.g., plug or pin). Fastening assembly 92A is configured such that fastener 921A can selectively couple the second hole of the slider with the first restricting hole of the central pole, thereby restricting the slider from moving along the central pole, or decouple the second hole of the slider from the first restricting hole of the central pole, thereby allowing the slider to move along the central pole.

In some embodiments, slider 91A includes a receiving space such as receiving space 913A formed in the upper portion of the slider, and fastening assembly 92A includes a linking lever such as linking lever 926A. Linking lever 926A is pivotally connected to the slider at a location between second hole 912A and receiving space 913A, where an upper portion of the linking lever is received in the receiving space. Fastener 921A has first and second ends. The first end of fastener 921A is to be selectively inserted into or released from first restricting hole 21 of the central pole, and the second end of fastener 921A is connected to a lower portion of linking lever 926A.

In some embodiments, slider 91A includes a raised or protruded pillar such as protruded pillar 914A formed in receiving space 913A, and fastening assembly 92A includes an elastic member such as elastic member 922A disposed between the upper portion of the linking lever and the protruded pillar of the slider. In some embodiments, the upper portion of the linking lever severs as a push button or is formed with a push button such as push button 927A, and elastic member 922A is disposed between the push button and the protruded pillar of the slider. Elastic member 922A pushes the upper portion of the linking lever away from the central pole, and consequently the lower portion of the linking lever pushes the fastener toward the central hole. When second hole 912A of the slider is aligned with first restricting hole 21 of the central pole, fastener 921A of fastening assembly 92A is pushed and inserted into first restricting hole 21 of the central pole, thus holding the tent frame in an unfolded state. Pressing the upper portion or the push button releases fastener 921A from the first restricting hole of the central hole, thus allowing the slider and the first connector to move along the central pole and allowing the tent frame to fold.

Figure 10:
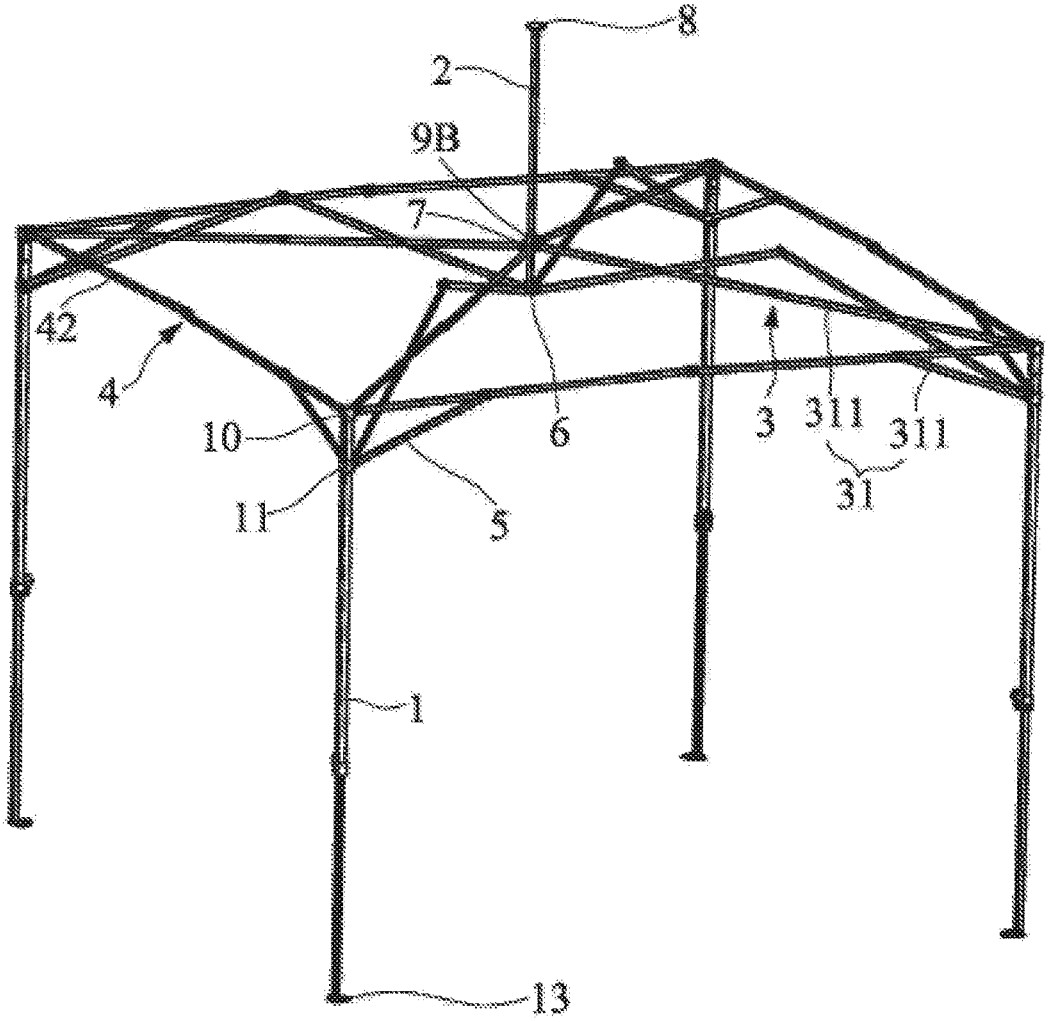
FIG. 10 is a schematic view illustrating a tent frame having a third exemplary centralized locking mechanism in an unfolded state in accordance with exemplary embodiments of the present invention.
Figure 11:
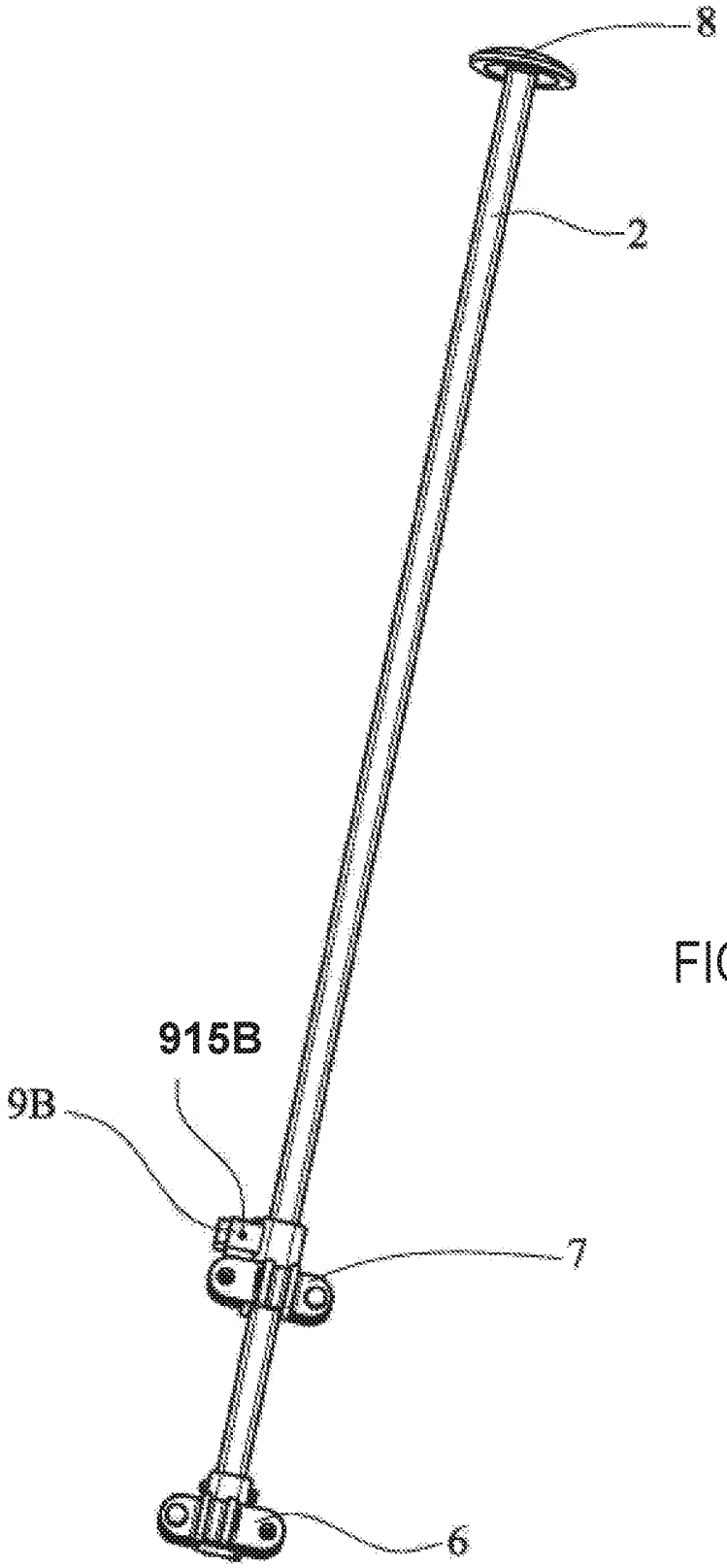
FIG. 11 is a schematic view illustrating the third exemplary centralized locking mechanism in accordance with exemplary embodiments of the present invention.
Figure 12:
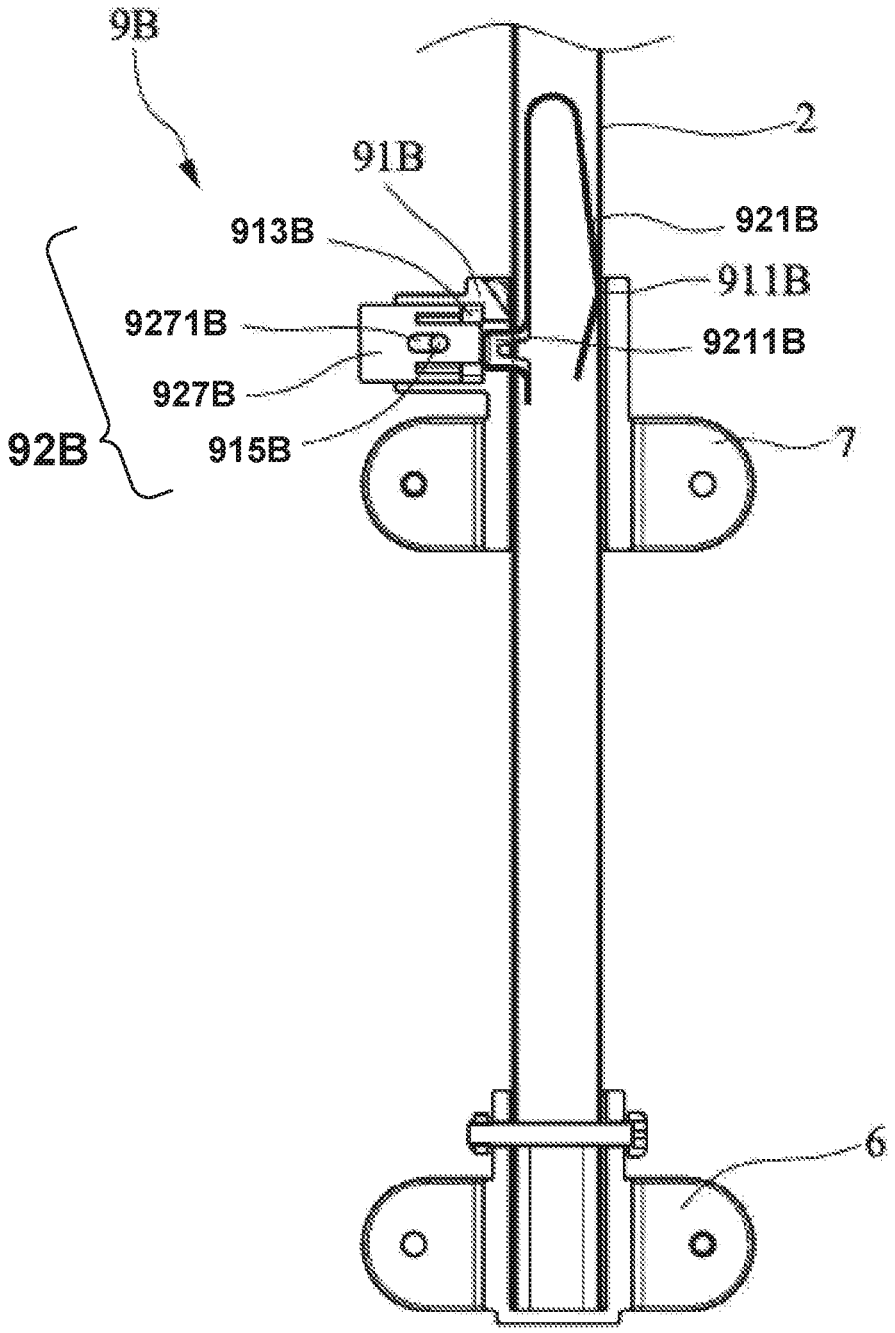
FIG. 12 is a cross-sectional view illustrating the third exemplary centralized locking mechanism in accordance with exemplary embodiments of the present invention.

Referring to FIGS. 10-12, there depicts a tent frame having third exemplary centralized locking mechanism 9B in accordance with some exemplary embodiments of the present invention. Similar to first exemplary centralized locking mechanism 9, third exemplary centralized locking mechanism 9B includes a slider such as slider 91B and a fastening assembly such as fastening assembly 92B coupled with slider 91B. Slider 91B is monolithically formed or fixedly coupled with first connector 7. It includes a first hole such as first hole 911B and a second hole such as second hole 912B. First hole 911B is formed in an axial direction to allow the central pole pass through and to allow the slider movably along the central pole. Second hole 912B formed in a transverse direction and intersecting first hole 911B. Fastening assembly 92B includes a fastener such as fastener 921B (e.g., elastic clip) disposed inside of the central pole. Fastening assembly 92B is configured such that fastener 921B can selectively couple the second hole of the slider with the first restricting hole of the central pole, thereby restricting the slider and the first connector from moving along the central pole, or decouple the second hole of the slider from the first restricting hole of the central pole, thereby allowing the slider and the first connector to move along the central pole.

In some embodiments, slider 91B includes a receiving space such as receiving space 913B distal from the first hole of the slider, and fastening assembly 92B includes a push button such as push button 927B received in the receiving space of the slider and movably coupled with the slider. To movably couple push button 927B with slider 91B, in some embodiments, slider 91B is formed with a pin hole such as pin hole 915B on one or more sides of the slider and push button 927B is formed with an elongated groove such as elongated groove 9271B on one or more sides of the push button. In the illustrated embodiments, fastener 921B includes protruded section 9211B. Protruded section 9211B protrudes out of the first restricting hole of the central pole and into the second hole of the slider, thereby coupling the slider with the central pole and restricting the slider and the first connector from moving along the central pole. Pressing push button 927B toward the central pole pushes the protruded section of the fastener out of the second hole of the slider, thereby decoupling the slider from the central pole and allowing the slider and the first connector to move along the central pole (e.g., to fold the tent frame).

Figure 17:
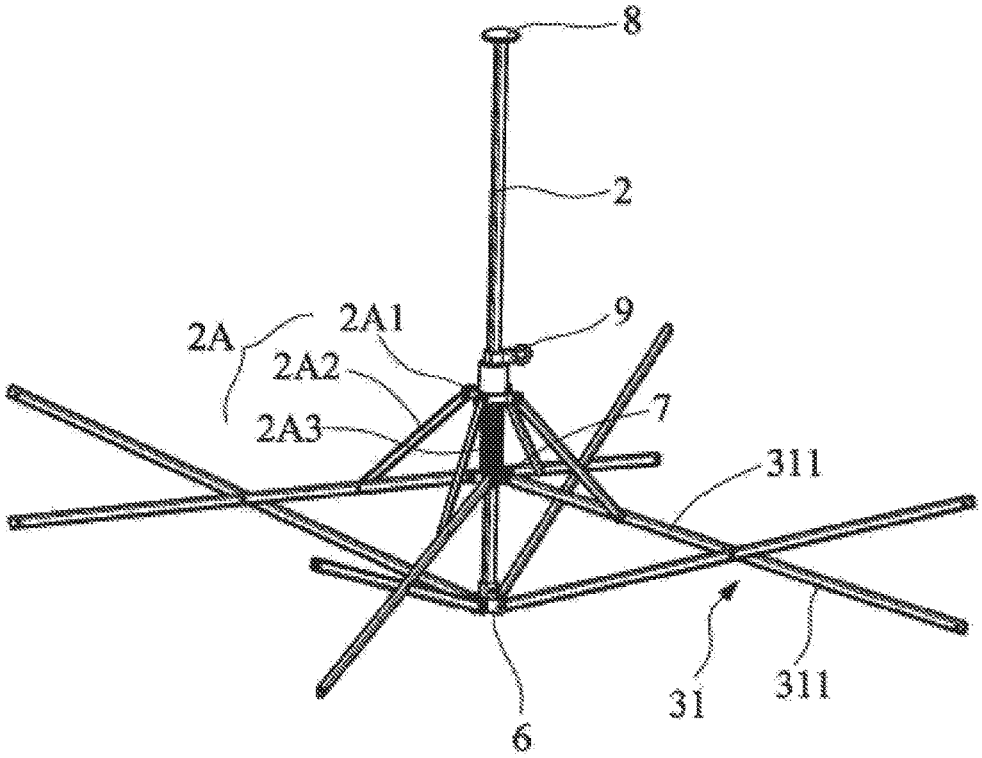
FIG. 17 is a schematic view illustrating a portion of a tent frame having an auxiliary mechanism in an unfolded state in accordance with exemplary embodiments of the present invention.
Figure 19:
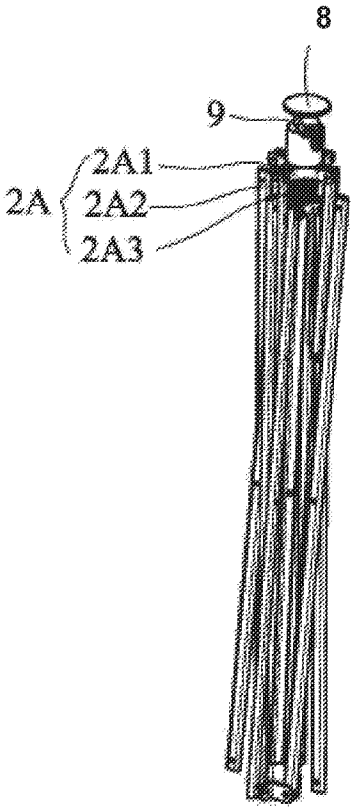
FIG. 19 is a schematic view illustrating the tent frame of FIG. 17 in a folded state.
Figure 18:
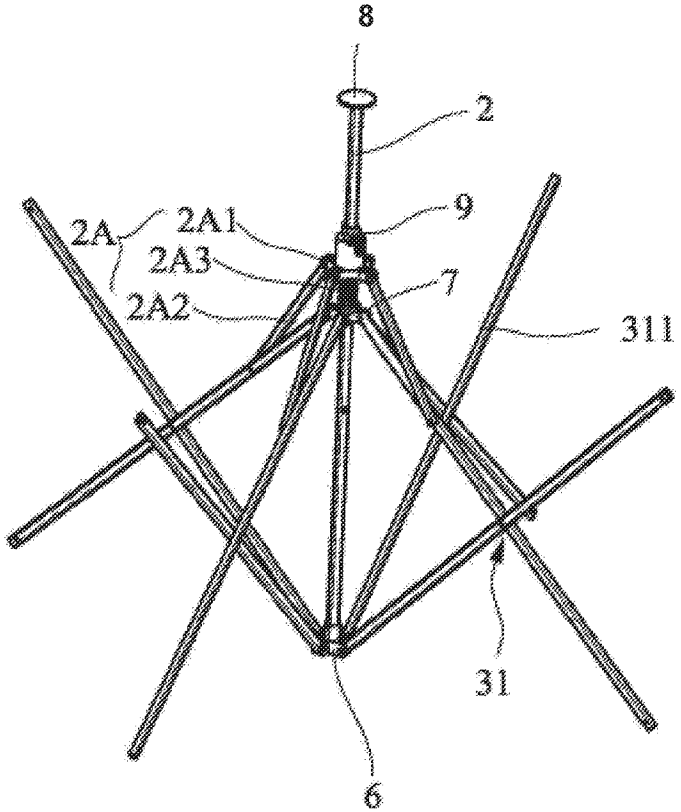
FIG. 18 is a schematic view illustrating the portion of the tent frame of FIG. 17 in a partially folded state.
Figure 20:
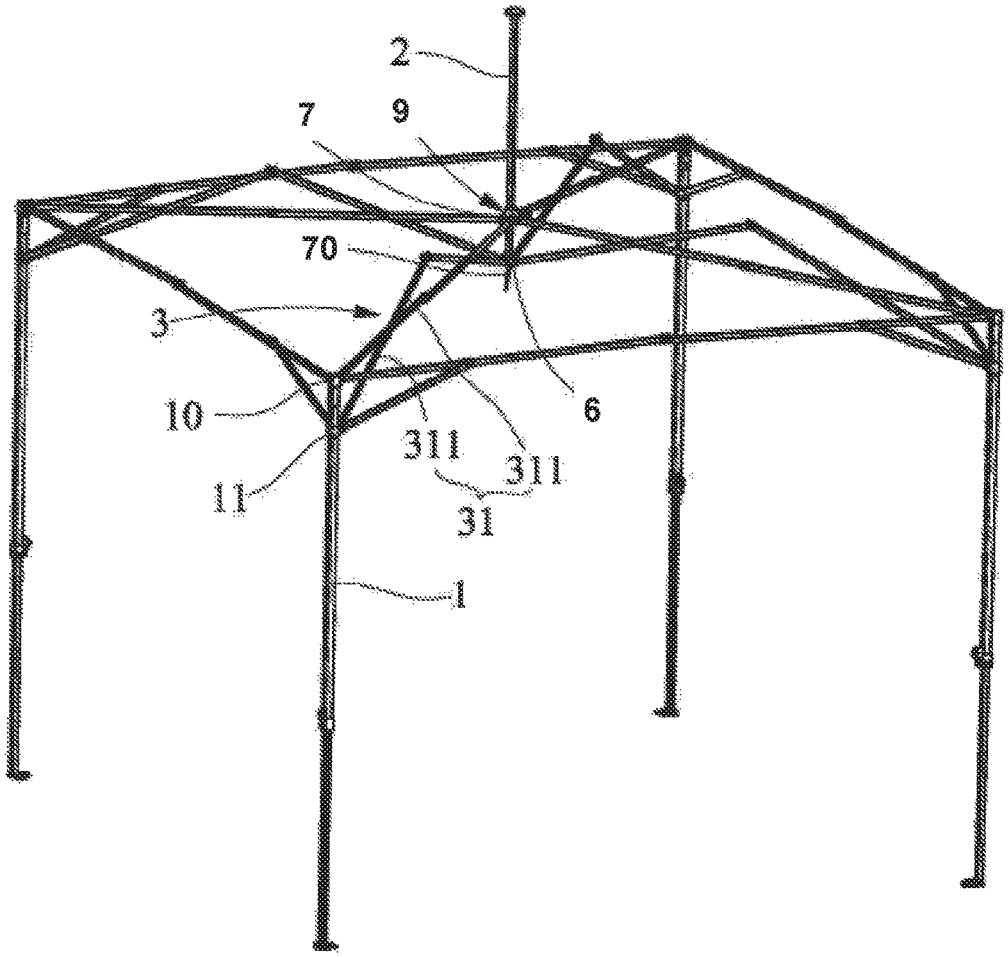
FIG. 20 is a schematic view illustrating a tent frame having an unlocking mechanism in an unfolded state in accordance with exemplary embodiments of the present invention.

Referring to FIGS. 17-19, there depicts a tent frame having an auxiliary mechanism such as auxiliary mechanism 2A for assisting folding and unfolding of the tent frame. In some embodiments, auxiliary mechanism 2A includes an auxiliary connector such as auxiliary connector 2A1, an elastic member such as second elastic member 2A3 and a plurality of auxiliary poles such as auxiliary poles 2A2. Auxiliary connector 2A1 and second elastic member 2A3 are slidably disposed on central pole 2 between first connector 7 and centralized locking mechanism 9. The centralized locking mechanism is disposed above auxiliary connector 2A1 when the tent frame is unfolded, with second elastic member 2A3 in between auxiliary connector 2A1 and first connector 7. Each auxiliary pole 2A2 has one end pivotally connected to auxiliary connector 2A1, and the other end pivotally connected to a corresponding upper connecting unit 3, and preferably, connected to upper pole 311 that is connected to first connector 7.

The centralized locking mechanism selectively restricts the auxiliary connector (and thus the first connector) from moving up along the central pole thereby holding the tent frame in an unfolded state, or releases the restriction thereby allowing the tent frame to fold. It should be noted that centralized locking mechanism 9 is shown in FIGS. 17-19 as an illustrative example, and other exemplary centralized locking mechanisms disclosed herein can be used.

Referring to FIGS. 20-24, there depicts a tent frame having an unlocking mechanism for controlling the centralized locking mechanism in accordance with some exemplary embodiments of the present invention. By way of example, centralized locking mechanism 9 is shown in FIGS. 20-24. It should be noted that other exemplary centralized locking mechanisms disclosed herein can be used.

As shown, in some embodiments, an unlocking mechanism such as unlocking mechanism 70 includes a pulling element such as second pull ring 73, an elastic member such as third elastic member 72, and a pull pole such as pull pole 71 slidably disposed in the central pole. Pull pole 71 includes a recessed neck such as recessed neck 711 formed at a lower end portion of the pull pole. The lower end of recessed neck 711 passes through a hole such as hole 62 formed at second connector 6. Third elastic member 72 is disposed on (e.g., sleeved on) recessed neck 711 and inside second connector 6. In some embodiments, hole 62 is a counterbore with a narrowed bottom 61. In such embodiments, the third elastic member has one end abutting the narrowed bottom of the hole and the other end abutting a shoulder formed by the recessed neck of the pull pole. The lower end of recessed neck 711 protrudes out of second connector 6 and is connected to second pull ring 73. In an embodiment, the lower end of the recessed neck is formed with a hole such as hole 715 for coupling with the second pulling element.

Pull pole 71 also includes a recessed groove such as recessed groove 713 formed at an upper portion of the pull pole and corresponding to first restricting hole 21 of central pole 2. Recessed groove 713 is formed with at least one surface, and preferably two surfaces, oblique to the longitudinal direction of the central pole.

Figure 21:
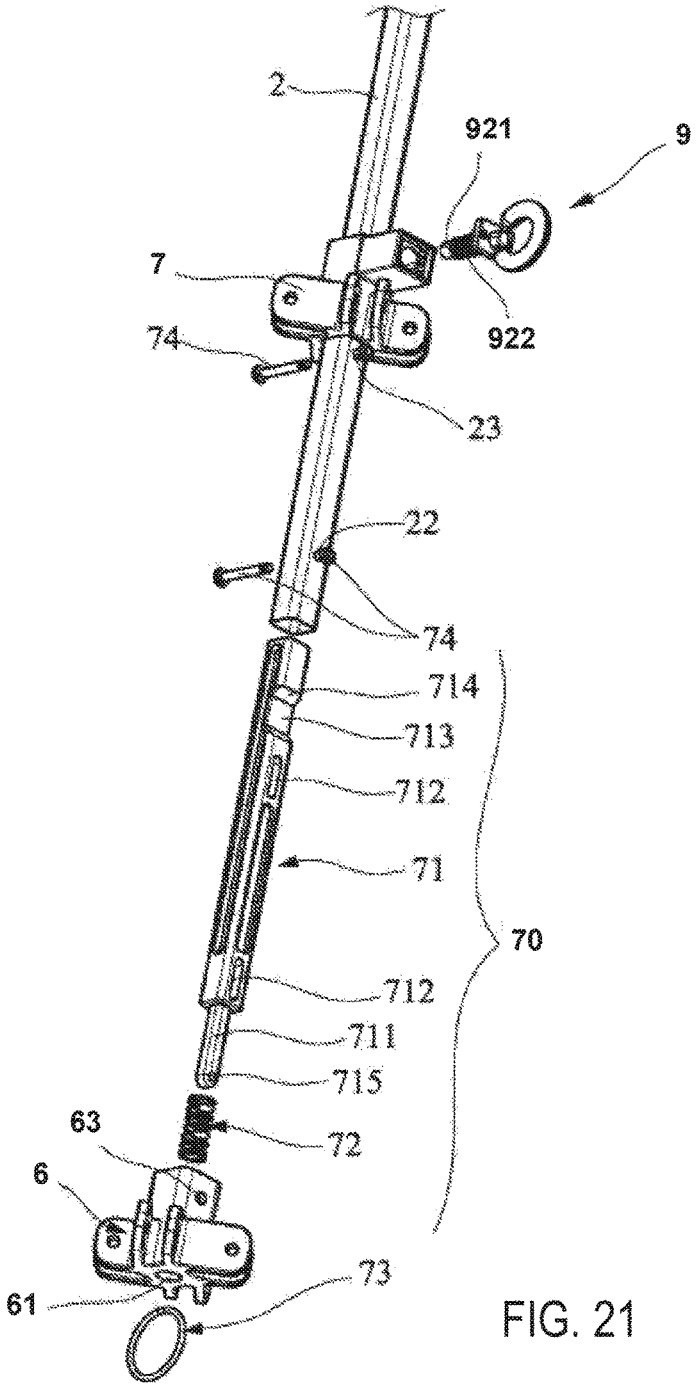
FIG. 21 is a partially disassembled view illustrating the unlocking mechanism in accordance with exemplary embodiments of the present invention.
Figure 22:
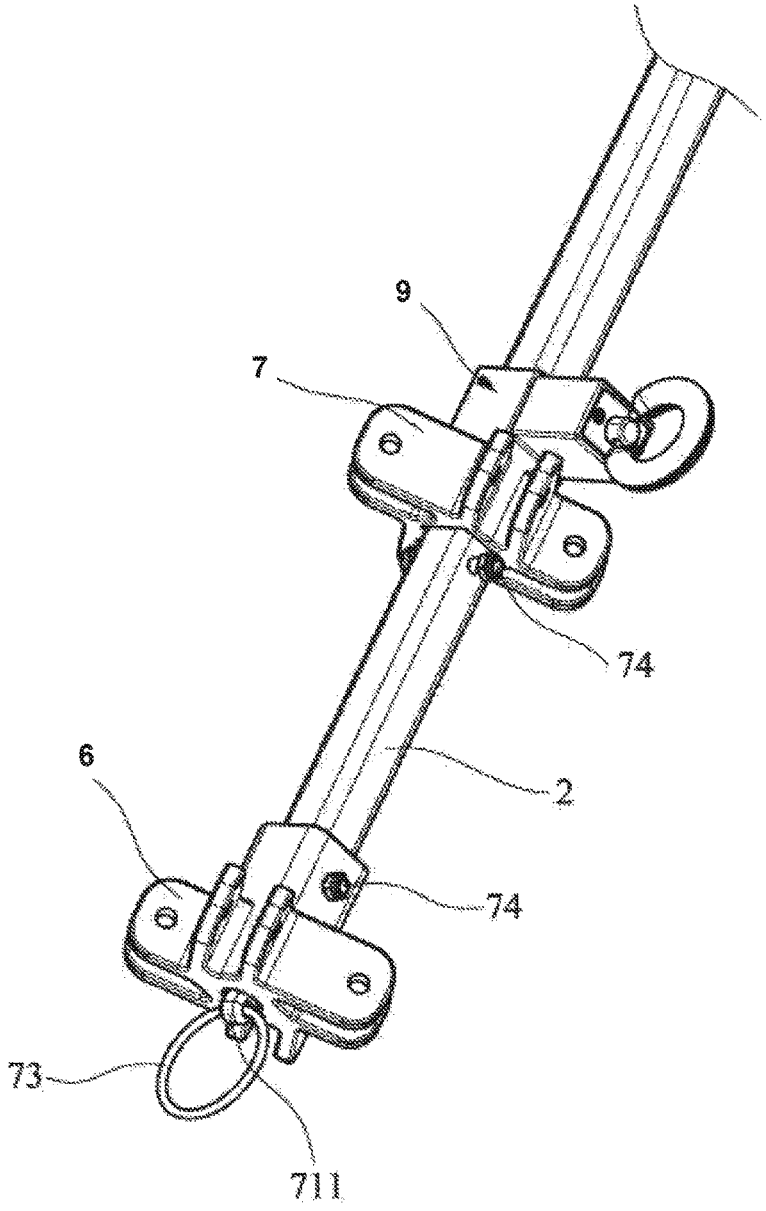
FIG. 22 is an assembled view illustrating the unlocking mechanism in accordance with exemplary embodiments of the present invention.

In some embodiments, pull pole 71 further includes one or more elongated slots formed between the recessed neck and the recessed groove. Corresponding to the elongated slots, central pole 2 includes one or more additional restricting holes formed on its peripheral wall. For example, FIG. 21 illustrates two elongated slots 712 formed on pull pole 71, and two additional restricting holes 22, 23 formed on central pole 2. The elongated slots of the pull pole and the additional restricting holes of the central pole are coupled to each other by fastening means such as bolts or pins 74. As such, the pull pole is movable with respect to the central pole, but within a distance defined by the length of the elongated slot(s). In some embodiments, second connector 6 is formed with a fixation hole such as fixation hole 63. Preferably, when the unlocking mechanism is assembly, fixation hole 63 of second connector 6 is aligned with fixation hole 22 of central pole and the lower elongated slot 712 of pull pole 71.

To assemble the unlocking mechanism illustrated in FIG. 21, insert pull pole 71 in central pole 2 and place (e.g., sleeve) elastic member 72 on recessed neck 711 of the pull pole. Insert recessed neck 711 of the pull pole, along with elastic member 72, in hole 62 of second connector until the lower end of recessed neck 711 of the pull pole protruding out of second connector 6. Fix the pull element on the lower end of recessed neck 711, e.g., coupling pulling ring 73 with hole 715 of the pull pole. Insert one fastening means 74 through fixation hole 63 of second connector 6, fixation hole 22 of central pole and the lower elongated slot 712 of pull pole 71, and insert another fastening means 74 through fixation hole 23 of central pole and the upper elongated slot 712 of pull pole 71. In a normal state, elastic member 72 pushes the pull pole up such that at least one fastening means 74 is located at the lower end of elongated slot 714. In such a state, recessed groove 713 of pull pole 71 is aligned with first restricting hole 21 of central pole 2.

Figure 23:
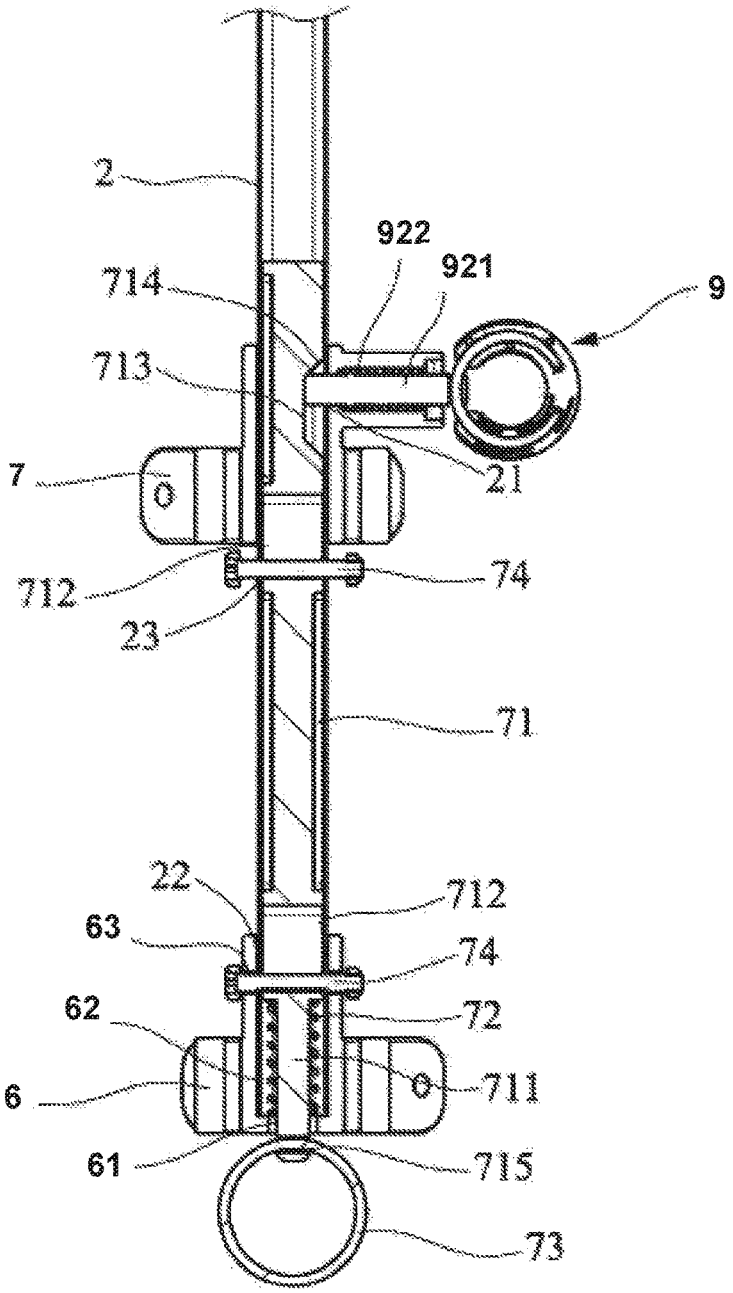
FIG. 23 is a cross-sectional view illustrating the unlocking mechanism in accordance with exemplary embodiments of the present invention.
Figure 24:
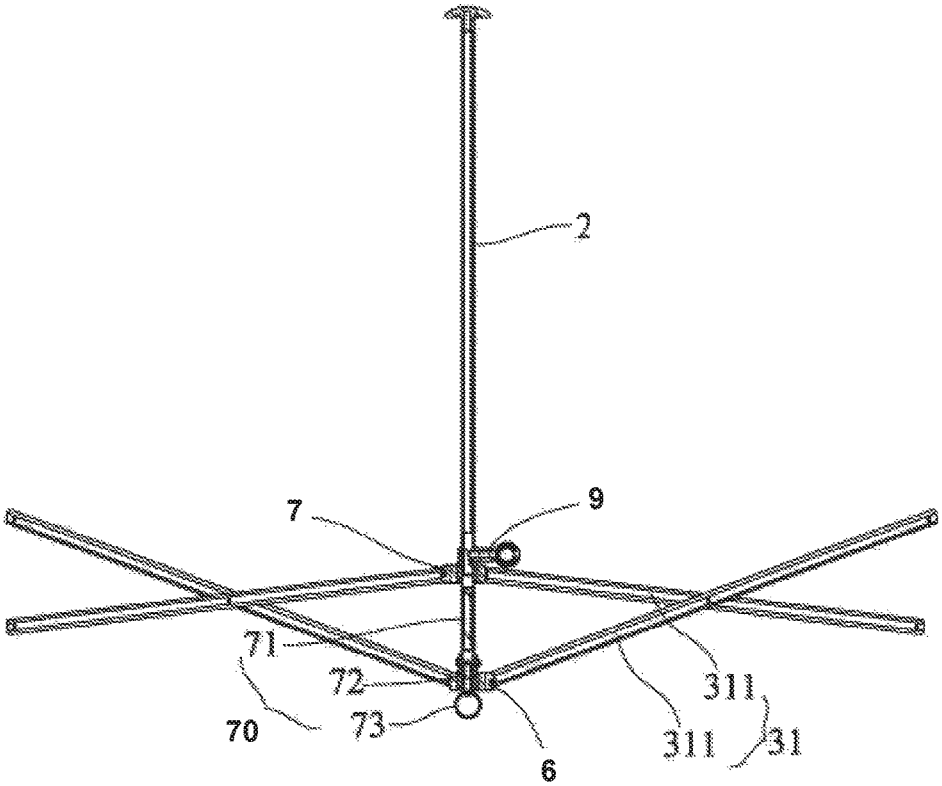
FIG. 24 is a schematic view illustrating a portion of the tent frame of FIG. 20 in an unfolded state.

To unfold the tent frame, move first connector 7 (and the slider of the centralized locking mechanism) along the central pole toward second connector 6. When fastener 921 of centralized locking mechanism 9 is aligned with first restricting hole 21 of central pole 2, it is pushed inward by elastic member 922, and inserted into first restricting hole 21 of central pole 2 and recessed groove 713 of pull pole 71, as illustrated in FIG. 23. As such, first connector 7 is restricted from moving up along the central pole, thus holding the tent frame in the unfolded state.

To unfold the tent frame, pull the pull pole downward with respect to the central pole, for example, by pulling downward ring 73. As the pull pole is moving downward, the oblique surface of the pull pole pushes the fastener of the centralized locking mechanism outward and out of the first fixation hole of the central pole, allowing the first connector moving up along the central pole. Since poles (e.g., supporting poles, upper poles, and side poles) are coupled to each other, the movement of the first connector pulls the upper connecting units, the supporting poles, and the side connecting units toward the central pole and folded onto the central pole. That is, from an unfolded state, pulling downward the pulling ring with respect to the central pole decouples the fastener of the centralized locking mechanism from the first fixation hole of the central pole. When the pulling ring is released (e.g., not pulled downward), the unlocking mechanism restores its normal state by the elastic force of the third elastic member.

Since the unlocking mechanism is installed at the lower end of the central pole, it is reachable without the need to first retract the supporting poles and the central pole or pulling down the whole tent, making the tent frame of the present invention more convenient to use. For example, to fold the tent frame, one can simply pull ring 73 downward, thereby unlocking the centralized locking mechanism and allowing the tent frame to fold.

As disclosed herein, a tent frame of the present invention includes a centralized locking mechanism disposed on the central pole. The centralized locking mechanism functions as a centralized key in folding and unfolding of the tent frame. As such, it simplifies the folding and unfolding processes, making it convenient to use. It also reduces the manufacturing cost of the tent frame. In addition, in embodiments where an unlocking mechanism is included, the tent frame is even more convenient to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "upward" or "downward", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. A tent frame comprising:

a central pole;

a first connector movably coupled with the central pole;

a second connector fixedly coupled with a lower end of the central pole;

a plurality of supporting poles;

a plurality of third connectors, each movably coupled with a corresponding supporting pole;

a plurality of fourth connectors, each fixedly coupled with an upper end of a corresponding supporting pole;

one or more upper connecting units, each pivotally connected to the first and second connectors disposed at the central pole, and pivotally connected to the third and fourth connectors disposed at a corresponding supporting pole; and a centralized locking mechanism configured to selectively restrict the first connector from moving along the central pole thereby holding the tent frame in an unfolded state, or release the restriction thereby allowing the tent frame to fold, wherein the central pole comprises a first restricting hole formed on its peripheral wall, and wherein the centralized locking mechanism comprises:

a slider coupled with the first connector, the slider comprising:

a first hole formed in an axial direction to allow the central pole passing through and to allow the slider movable along the central pole, and a second hole formed in a transverse direction and intersecting with the first hole; and a fastening assembly coupled with the slider, and comprising a fastener configured to selectively:

couple the second hole of the slider with the first restricting hole of the central pole, thereby restricting the slider from moving along the central pole, and decouple the second hole of the slider from the first restricting hole of the central pole, thereby allowing the slider to move along the central pole.

2. The tent frame of claim 1, wherein:

each upper connecting unit comprises one or more upper pole pairs;

each upper pole pair comprises two upper poles pivotally connected to each other and forming an "X" shape when unfolded; and ends of adjacent upper pole pairs in each upper connecting unit are pivotally connected to each other.

3. The tent frame of claim 1, further comprising:

one or more side connecting units, each disposed between two adjacent supporting poles and having two ends pivotally connected to the fourth connectors that are fixedly coupled with the two adjacent supporting poles; and optionally, a plurality of oblique poles, each oblique pole pivotally connected to a corresponding side connecting unit, and having one end pivotally connected to the third connector that is movably coupled with a corresponding supporting pole.

4. The tent frame of claim 3, wherein at least one side connecting unit comprises two or more side poles pivotally connected to each other.

5. The tent frame of claim 3, wherein at least one side connecting unit comprises two or more side pole pairs, wherein:

each side pole pair comprises two side poles pivotally connected to each other and forming an "X" shape when unfolded;

adjacent side pole pairs are pivotally connected to each other at ends of corresponding side poles; and side poles at both ends of the side connecting unit are pivotally connected to the third and fourth connectors at adjacent supporting poles.

6. The tent frame of claim 3, wherein each oblique pole is pivotally connected to a side pole of the corresponding connecting unit and the side pole is connected to the fourth connector at the corresponding supporting pole, such that a portion of the oblique pole is extended obliquely upward above the side pole when unfolded.

7. The tent frame of claim 3, wherein the plurality of side connecting units comprises:

a first side connecting unit disposed at one side of the tent frame when unfolded, and a second side connecting unit disposed at another side of the tent frame when unfolded, wherein the second side connecting unit is different than the first side connecting unit.

8. The tent frame of claim 1, wherein the slider further comprises a receiving space for receiving the fastener of the fastening assembly, wherein the fastener has first and second ends, with the first end toward the first hole of the slider and configured to be selectively inserted into or released from the first restricting hole of the central pole.

9. The tent frame of claim 8, wherein the fastening assembly further comprises a first pulling element connected to the second end of the fastener.

10. The tent frame of claim 8, wherein the fastening assembly further comprises:

a restricting block disposed at or formed with the fastener adjacent the second end of the fastener;

a protruded ring disposed at or formed with the fastener adjacent the first end of the fastener; and an elastic member disposed on the fastener and having one end abutting the protruded ring and the other end abutting the restricting block.

11. The tent frame of claim 10, wherein the fastening assembly further comprises a fastening means to fix the restricting block on the slider.

12. The tent frame of claim 1, wherein:

the slider further comprises a receiving space formed above the second hole of the slider;

the fastening assembly further comprises a linking lever pivotally connected to the slider at a location between the second hole and the receiving space;

an upper portion of the linking lever is received in the receiving space of the slider; and the fastener has first and second ends, wherein the first end is to be selectively inserted into or released from the first restricting hole of the central pole, and the second end is connected to a lower portion of the linking lever.

13. The tent frame of claim 12, wherein:

the slider further comprises a protruded pillar formed in the receiving space; and the fastening assembly further comprises an elastic member disposed between the upper portion of the linking lever and the protruded pillar of the slider, wherein the elastic member pushes the upper portion of the linking lever away from the central pole, thereby inserting the fastener into the first restricting hole of the central hole.

14. The tent frame of claim 13, wherein the upper portion of the linking lever severs as or is formed with a push button, wherein pressing the push button toward the central pole releases the fastener from the first restricting hole of the central hole.

15. The tent frame of claim 1, wherein the fastener is an elastic clip disposed inside of the central pole, and comprises a protruded section configured to be selectively protruded out of the first restricting hole of the central pole and into the second hole of the slider, thereby coupling the slider with the central pole and restricting the slider and the first connector from moving along the central pole.

16. The tent frame of claim 15, wherein:

the slider further comprises a receiving space distal from the first hole of the slider;

the fastening assembly further comprises a push button received in the receiving space of the slider and movably coupled with the slider, wherein pressing the push button toward the central pole releases the protruded section of the fastener from the second hole of the slider, thereby decoupling the slider from the central pole, and allowing the slider and the first connector to move along the central pole.

17. The tent frame of claim 16, wherein the push button is movably coupled with the slider through one or more pin holes formed on the slider and one or more corresponding elongated grooves formed on the push bottom along the transverse direction.

18. The tent frame of claim 1, further comprising an auxiliary mechanism for assisting folding and unfolding of the tent frame, wherein the auxiliary mechanism comprises:

an auxiliary connector slidably disposed on the central pole between the first connector and the centralized locking mechanism;

a second elastic member slidably disposed on the central pole between the first connector and the auxiliary connector; and a plurality of auxiliary poles, each having one end pivotally connected to the auxiliary connector and the other end pivotally connected to a corresponding upper connecting unit.

19. The tent frame of claim 18, wherein the other end of each auxiliary pole is pivotally connected to an upper pole of the corresponding upper connecting unit, wherein the upper pole is pivotally connected to the first connector.

20. The tent frame of claim 1, further comprising an unlocking mechanism for controlling the centralized locking mechanism, wherein the unlocking mechanism comprises:

a second pulling element;

a third elastic member; and a pull pole slidably disposed in the central pole, the pull pole comprising a recessed neck formed at a lower end portion thereof, and a recessed groove formed at an upper portion thereof and corresponding to the first restricting hole of the central pole, wherein a lower end of the recessed neck passes through the second connector and connected to the second pulling element;

the third elastic member is disposed on the recessed neck inside the second connector;

at least one surface of the recessed groove is oblique with respect to a longitudinal direction of the central pole; and the fastener of the centralized locking mechanism is configured to be selectively inserted into the recessed groove of the pull pole and the first restricting hole of the central pole to restrict the slider and the first connector from moving along the central pole, and to be selectively retrieved from the recessed groove of the pull pole and the restricting hole of the central pole to allow the slider and the first connector to move along the central pole.

21. The tent frame of claim 20, wherein the second connector is formed with a hole to allow the lower end of the recessed neck passes through, the hole has a narrowed bottom, wherein the third elastic member has one end abutting the narrowed bottom of the hole and the other end abutting a shoulder formed by the recessed neck of the pull pole.

22. The tent frame of claim 20, wherein the pull pole further comprises one or more elongated slots formed between the recessed neck and the recessed groove;

the central pole comprises one or more additional restricting holes formed on its peripheral wall and corresponding to the one or more elongated slots; and the unlocking mechanism further comprises one or more pins slidably coupling the one or more elongated slots with the one or more additional restricting holes, thereby limiting a moving distance of the pull pole.

23. A tent frame assembly, comprising:

two or more tent frames of claim 1 coupled to each other, wherein adjacent tent frames share one or more supporting poles.

* * * * *